US007352348B2

(12) United States Patent
Hosaka et al.

(10) Patent No.: US 7,352,348 B2
(45) Date of Patent: Apr. 1, 2008

(54) DRIVING CIRCUIT AND DRIVING METHOD FOR ELECTRO-OPTICAL DEVICE

(75) Inventors: Hiroyuki Hosaka, Suwa (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 598 days.

(21) Appl. No.: 11/054,599

(22) Filed: Feb. 10, 2005

(65) Prior Publication Data

US 2005/0179679 A1 Aug. 18, 2005

(30) Foreign Application Priority Data

Feb. 12, 2004 (JP) ..... 2004-035086
Sep. 8, 2004 (JP) ..... 2004-260551

(51) Int. Cl.
*G09G 3/36* (2006.01)

(52) U.S. Cl. ..... 345/89; 345/98; 345/690

(58) Field of Classification Search ..... 345/87, 345/89, 98, 100, 204, 690
See application file for complete search history.

(56) References Cited

U.S. PATENT DOCUMENTS 5,907,314 A 5/1999 Negishi et al.
6,661,401 B1 12/2003 Sekine
2001/0013850 A1 8/2001 Sakaguchi et al.

FOREIGN PATENT DOCUMENTS

EP 0 558 056 A1 9/1993
EP 1 406 242 A2 4/2004
JP A-05-313608 11/1993
JP A-2004-177930 6/2004

OTHER PUBLICATIONS

U.S. Appl. No. 10/667,340, filed Sep. 23, 2003, Hidehito Iisaka.

*Primary Examiner*—Regina Liang
(74) *Attorney, Agent, or Firm*—Oliff & Berridge, PLC

(57) ABSTRACT

Exemplary embodiments of the present invention provide an image rearranging unit that synthesizes an input image with a delayed signal thereof and arranges an image having a horizontal frequency n times larger than a horizontal frequency of the input image in a signal arrangement according to scanning of a scanning driver, to thereby obtain a write image. The scanning driver selects n scanning lines spaced apart from each other in one horizontal period of the input image and drives pixels with image signals having the same polarity between most adjacent lines. Thus, a horizontal electric field can be reduced or prevented by a plane inversion driving. Adjacent to a blanking period having a polarity, a write operation by an image signal having an opposite polarity is performed. In this case, however, a low level blanking signal, for example, is also used, instead of a blanking signal. Thus, in the blanking period, the write operation of the image signal is not affected by a high black level ghost. As a result, display quality can be reduced or prevented from deteriorating.

20 Claims, 29 Drawing Sheets

DY

CLY $\overline{CLY}$

ENBY1

ENBY2

G1

G2

$\frac{Gm}{2}$ $\frac{Gm}{2}+1$ $\frac{Gm}{2}+2$ $\frac{Gm}{2}+3$

Sn
LCCOM
ONE HORIZONTAL WRITE PERIOD

DY

CLY $\overline{CLY}$

ENBY1

ENBY2

G1

G2

Gm−2

Gm−1

Gm

Gm+1

Sn
LCCOM
ONE HORIZONTAL WRITE PERIOD

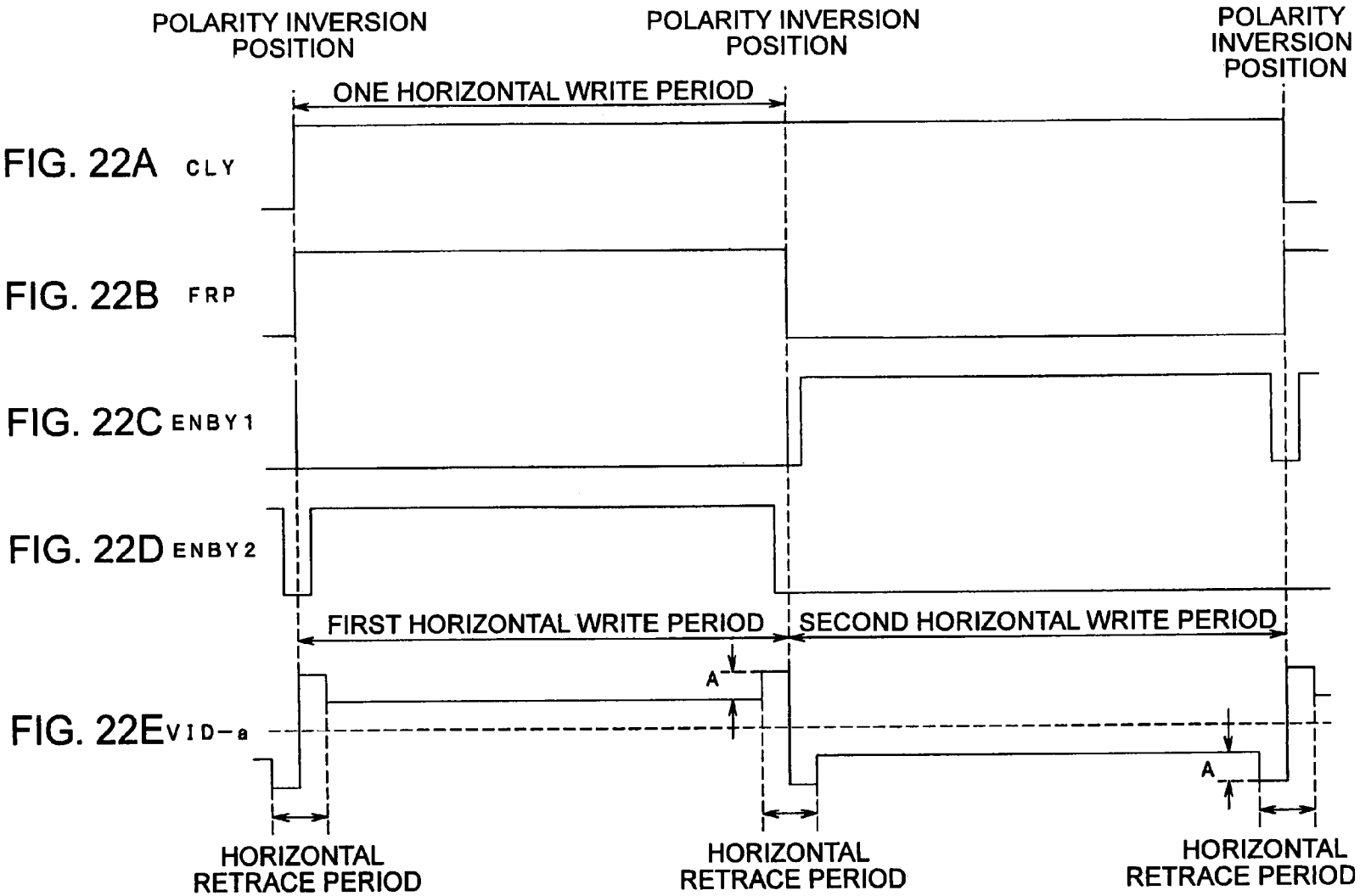
POLARITY INVERSION POSITION
POLARITY INVERSION POSITION
POLARITY INVERSION POSITION
ONE HORIZONTAL WRITE PERIOD
FIRST HORIZONTAL WRITE PERIOD
SECOND HORIZONTAL WRITE PERIOD
A
A
HORIZONTAL RETRACE PERIOD
HORIZONTAL RETRACE PERIOD
HORIZONTAL RETRACE PERIOD
FIG. 22A CLY
FIG. 22B FRP
FIG. 22C ENBY1
FIG. 22D ENBY2
FIG. 22E VID-a POLARITY INVERSION POSITION
POLARITY INVERSION POSITION
POLARITY INVERSION POSITION
ONE HORIZONTAL WRITE PERIOD
HORIZONTAL RETRACE PERIOD
HORIZONTAL RETRACE PERIOD
HORIZONTAL RETRACE PERIOD
A
A
FIG. 25A CLY
FIG. 25B FRP
FIG. 25C ENBY1
FIG. 25D ENBY2
FIG. 25E VID-a POLARITY INVERSION POSITION
POLARITY INVERSION POSITION
POLARITY INVERSION POSITION
ONE HORIZONTAL WRITE PERIOD
HORIZONTAL RETRACE PERIOD
HORIZONTAL RETRACE PERIOD
HORIZONTAL RETRACE PERIOD
A
B
FIG. 29A CLY
FIG. 29B FRP
FIG. 29C ENBY1
FIG. 29D ENBY2
FIG. 29E VID-a

DRIVING CIRCUIT AND DRIVING METHOD FOR ELECTRO-OPTICAL DEVICE

This application claims benefit of Japanese Application Nos. 2004-035086 filed in Japan on Feb. 12, 2004 and 2004-260551 filed in Japan on Sep. 8, 2004, the contents of which are incorporated by this reference.

BACKGROUND

Exemplary embodiments of the present invention relate to a driving circuit and a driving method for an electro-optical device which reduce crosstalk and display unevenness.

The related art includes electro-optical devices, such as liquid crystal display devices using liquid crystal as an electro-optical material for display units in various information processing apparatuses, for liquid crystal televisions, and for devices usable as display devices which substitute cathode ray tubes (CRTs).

Such a liquid-crystal display device, for example, includes an element substrate provided with pixel electrodes arranged in a matrix shape and switching elements, such as TFTs (Thin Film Transistors), connected to the pixel electrodes, a counter substrate on which a counter electrode which faces the pixel electrodes, is formed, and liquid crystal, which is an electro-optical material, filled between the substrates.

The TFT is turned on by a scanning signal (gate signal) which is supplied through a scanning line (gate line). When the scanning signal is applied to the switching element to turn it on, an image signal having a voltage corresponding to a gray-scale level is applied to the pixel electrode through a data line (source line). In doing so, an electric charge corresponding to the voltage of the image signal is accumulated in a liquid crystal layer between the pixel electrode and the counter electrode. After the electric charge is accumulated, even if the scanning signal is removed to turn off the TFT, the accumulated electric charge in each electrode is maintained by the capacitive characteristic of the liquid crystal layer or a storage capacitor.

When the switching element is driven and the amount of the accumulated electric charge is controlled according to the gray-scale level in such a manner, the alignment state of the liquid crystal changes for every pixel, optical transmittance changes, and brightness changes for every pixel, thereby making it possible to display the gray-scale.

In the liquid crystal device, the application of the DC component of an applied signal may cause the decomposition of the liquid crystal, contamination due to impurities in liquid-crystal cells, displayed-image sticking, and others. Therefore, in general, an inversion driving which inverts a polarity of a driving voltage for each pixel electrode, for example, at each frame of an image signal, is performed. A plane inversion driving such as a frame inversion driving is a method in that polarities of driving voltages for all pixel electrodes constituting an image display region are made identical, and thus the driving voltages are inverted at a constant interval.

With the capacitive characteristic of the liquid crystal layer and the storage capacitor being taken into account, the charge needs to be applied to the liquid crystal layer at each pixel just for a partial period. Therefore, to drive a plurality of pixels arranged in a matrix shape, it is necessary that a scanning signal be simultaneously applied to pixels connected to the same scanning line through the scanning line, image signals be supplied to the pixels through the data lines, and the scanning line to which the image signals are supplied be sequentially switched. In other words, in the liquid crystal display device, a time division multiplex driving system is allowed, in which the scanning lines and the data lines are shared by a plurality of pixels.

As described above, in the liquid crystal device, the driving voltages are applied to the pixels just for a partial period with the capacitive characteristic being taken into account. Even when the TFTs are turned off, however, the pixel electrodes are influenced by potentials on the source lines due to the effect of coupling capacitors and the leakage of the electric charge. Such a potential fluctuation on a voltage applied to pixels causes non-uniform display in a screen and image quality deterioration especially at a half tone region.

Therefore, in order to address and/or avoid such problems, an inversion driving system in which an inversion driving performed at each frame and a line inversion driving for changing the polarities of driving potentials at each line are incorporated is adapted in the liquid crystal device. Since the polarities of the image signals supplied through the source lines are switched in a relatively short time, the effects of the coupling capacitors and the leakage of the electric charge are reduced.

However, in the case of the line inversion driving system, an electric field (hereinafter, referred to as a horizontal electric field) is generated between adjacent pixel electrodes on the same substrate in the column or row direction in which voltages having different polarities are applied. Further, in a dot inversion driving system, a horizontal electric field is generated between adjacent pixel electrodes in the row or column direction in which voltages having different polarities are applied.

When such a horizontal electric field is generated between adjacent pixel electrodes, at an edge of the pixel electrode, the tilt direction of the liquid crystal molecules is affected by the horizontal electric field to disorder the alignment of the liquid crystal. Due to the alignment turbulence (disclination) of the liquid crystal molecules, a stripe shape (stripe unevenness) appears along the defective alignment portion. That is, light leakage occurs in the disclination region. Further, when the disclination region is made of a non-opened region, an aperture ratio is lowered.

Related art document Japanese Unexamined Patent Application Publication No. 5-313608 discloses a technique in which disclination due to the horizontal electric field is reduced or suppressed and uniformity of the screen is secured. In this technique, one horizontal period is divided into a first period and a second period. Specifically, in the first period, driving pulses are applied to the scanning lines and the image signals are supplied to the data lines, such that the image signals are applied to the pixel electrodes. Further, in the second period, image signals having opposite polarities to the image signals previously applied are supplied to the data lines, without supplying the driving pulses to the scanning lines.

However, in the technique disclosed in Japanese Unexamined Patent Application Publication No. 5-313608, the time to be used for writing onto the pixels is a half of the normal time. Accordingly, there is a problem in that the write time is not sufficient.

SUMMARY

Exemplary embodiments of the present invention provides a driving circuit and a driving method for an electro-optical device which can reduce or suppress disclination, reduce or prevent a problem, such as a deficiency in writing, and enhance uniformity of display quality on a screen.

A driving circuit for an electro-optical device of exemplary embodiments of the present invention includes a display unit which has pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements, and a scanning driver, with respect to the display unit, to select n, where n is an integer of 2 or greater, scanning lines spaced apart from each other in one horizontal period of an input image corresponding to the number of pixels in the display unit to sequentially supply gate pulses to the selected n scanning lines and to shift the selected n scanning lines by one line in the next one horizontal period. Exemplary embodiments further provide an image rearranging unit to convert a blanking signal included in the input image into a blanking signal having a predetermined level, to synthesize an input image including the level-converted blanking signal with a delayed signal thereof, and to arrange the synthesized image having a horizontal frequency n times larger than a horizontal frequency of the input image in a signal arrangement according to scanning of the scanning driver, thereby obtaining a write image. Exemplary embodiments further provide a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

Further, a driving method for an electro-optical device of exemplary embodiments of the present invention includes: first, with respect to a display unit which has pixels formed at intersections of a plurality of source lines and a plurality of scanning lines which are arranged to cross each other and an electro-optical material driven by turning on switching elements provided in the pixels by scanning signals supplied via the scanning lines and by supplying image signals supplied to the source lines to pixel electrodes of the respective pixels via the switching elements, selecting n, where n is an integer of 2 or greater, scanning lines spaced apart from each other in one horizontal period of an input image corresponding to the number of pixels in the display unit to sequentially supply gate pulses to the selected n scanning lines, and shifting the selected n scanning lines by one line in the next one horizontal period. Second, exemplary embodiments further provide converting a blanking signal included in the input image into a blanking signal having a predetermined gray level, synthesizing an input image including the level-converted blanking signal with a delayed signal thereof, and arranging the synthesized image having a horizontal frequency n times larger than a horizontal frequency of the input image in a signal arrangement according to scanning in the first step, thereby obtaining a write image. Third, exemplary embodiments further provide receiving an image signal of the write image obtained in the second step and inverting the polarity of the image signal for every horizontal write period, the horizontal write period being 1/n times smaller than the horizontal period of the input image, to supply the image signal to the plurality of source lines.

The above discussed and/or other objects, features and advantages of exemplary embodiments of the invention will become more clearly understood from the following description referring to the accompanying drawings.

BRIEF DESCRIPTION OF THE DRAWINGS

FIGS. 22A to 22E are schematic timing charts showing relationships between enable signals ENBY1 and ENBY2 and a level of a horizontal retrace period in the exemplary embodiment of the present invention;

DETAILED DESCRIPTION OF PREFERRED EMBODIMENTS

Figure 1:
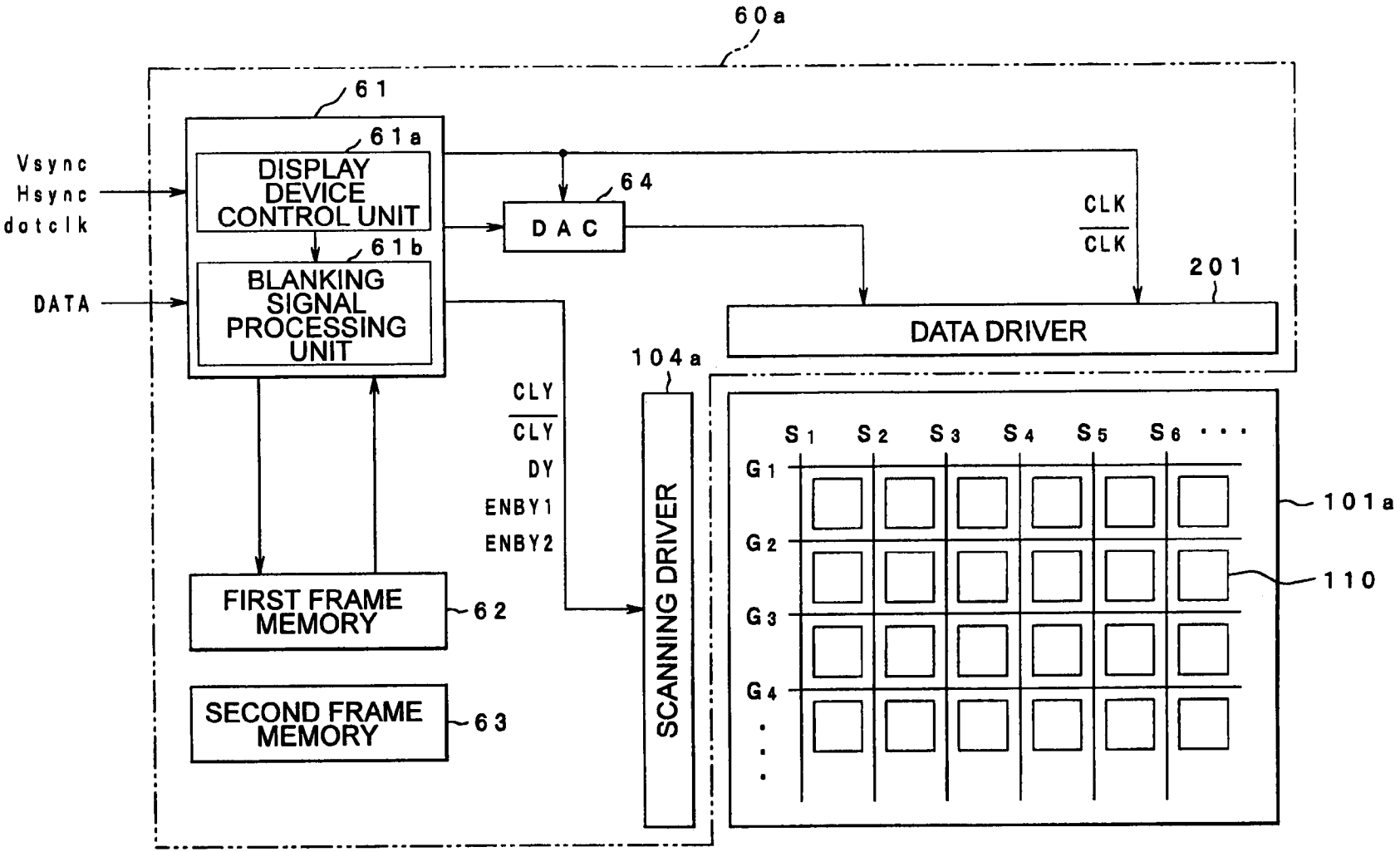
FIG. 1 is a schematic showing an electro-optical device according to a first exemplary embodiment of the present invention.
Figure 2:
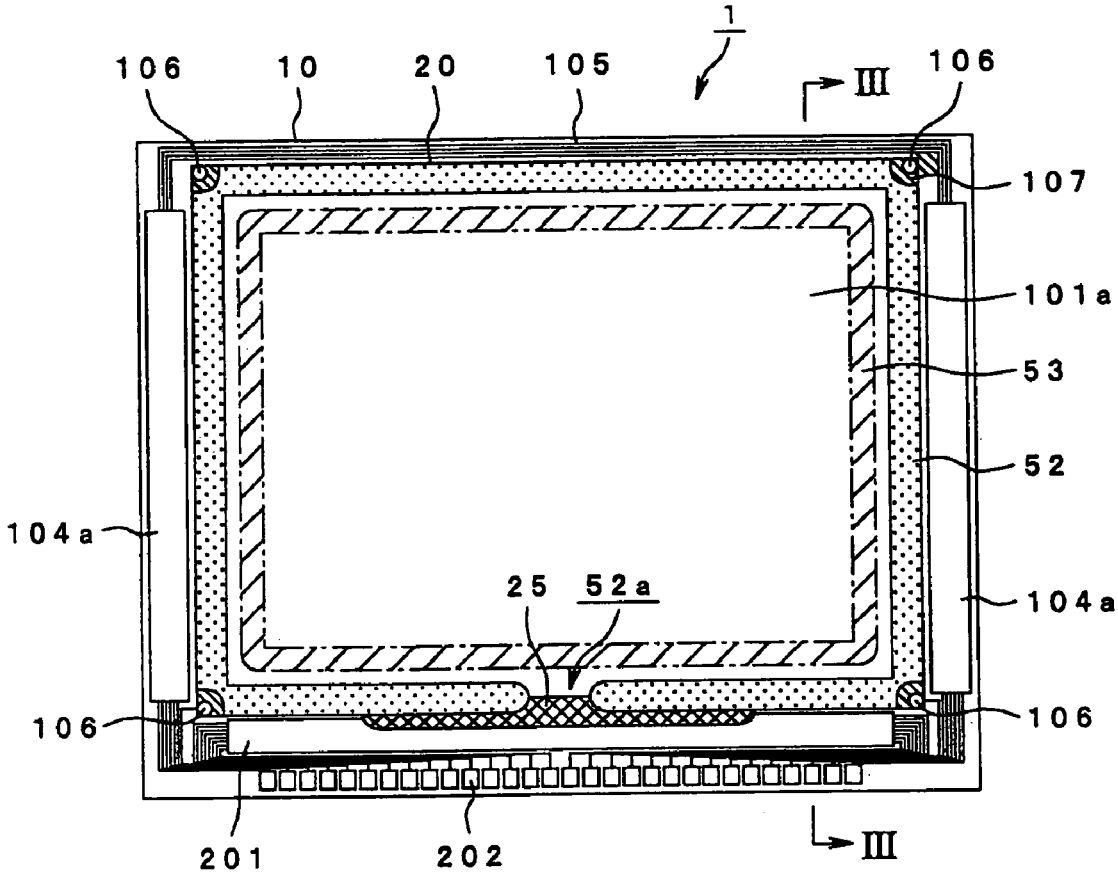
FIG. 2 is a schematic showing a configuration of a liquid crystal panel to be adapted when the exemplary embodiment of the present invention is applied to a liquid crystal device.
Figure 3:
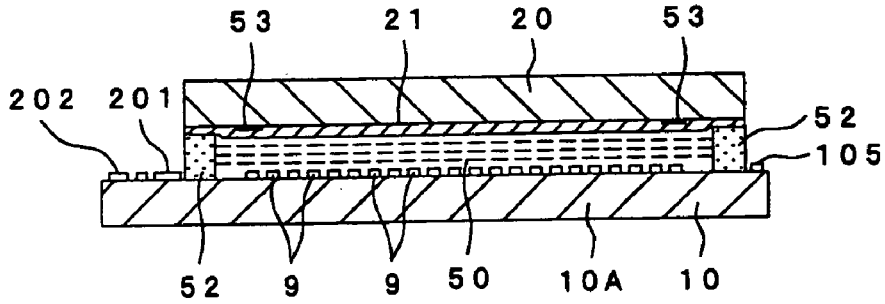
FIG. 3 is a schematic cross-sectional view taken along the line H-H' of FIG. 2.
Figure 4:
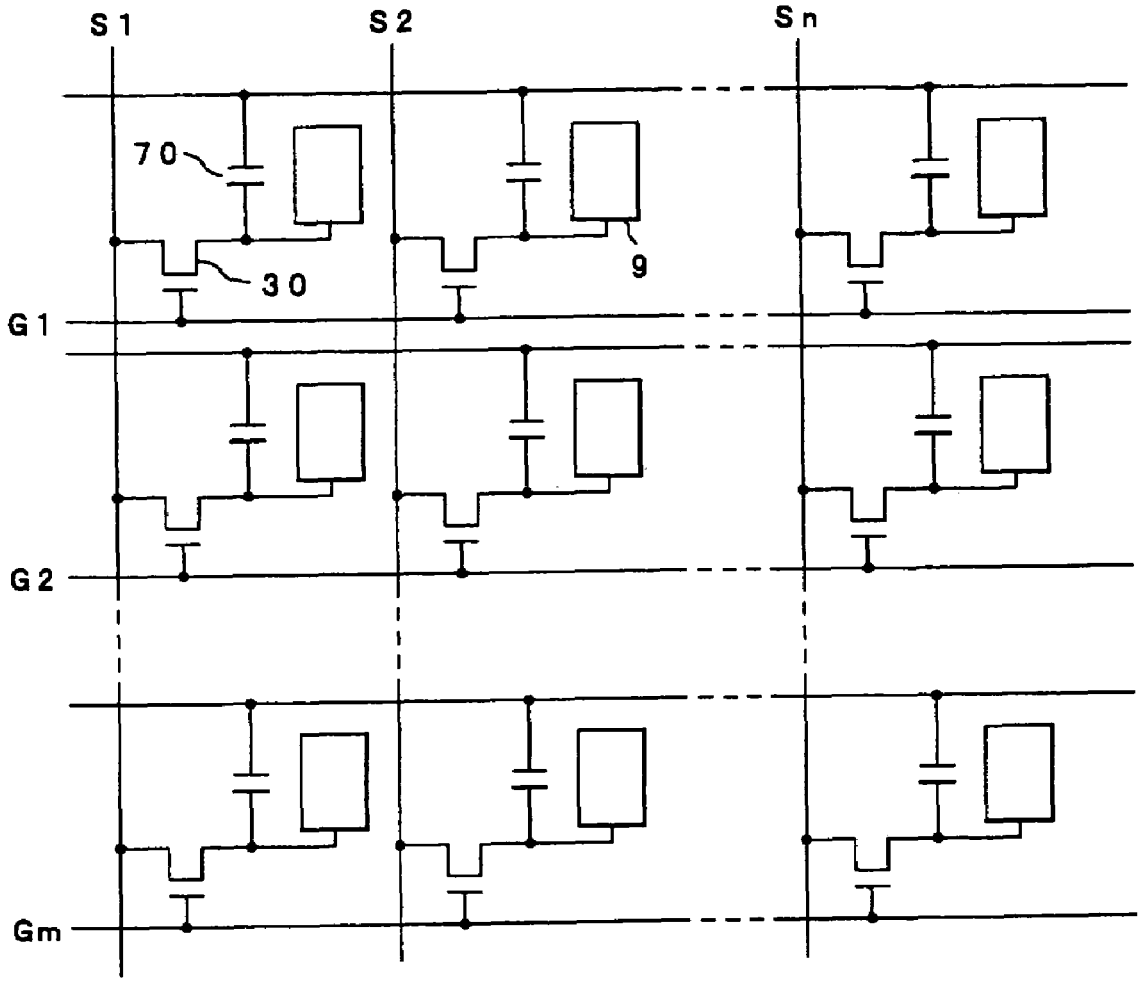
FIG. 4 is a schematic equivalent circuit diagram of a plurality of pixels arranged in a matrix shape in a pixel region of the liquid crystal panel.
Figure 5:
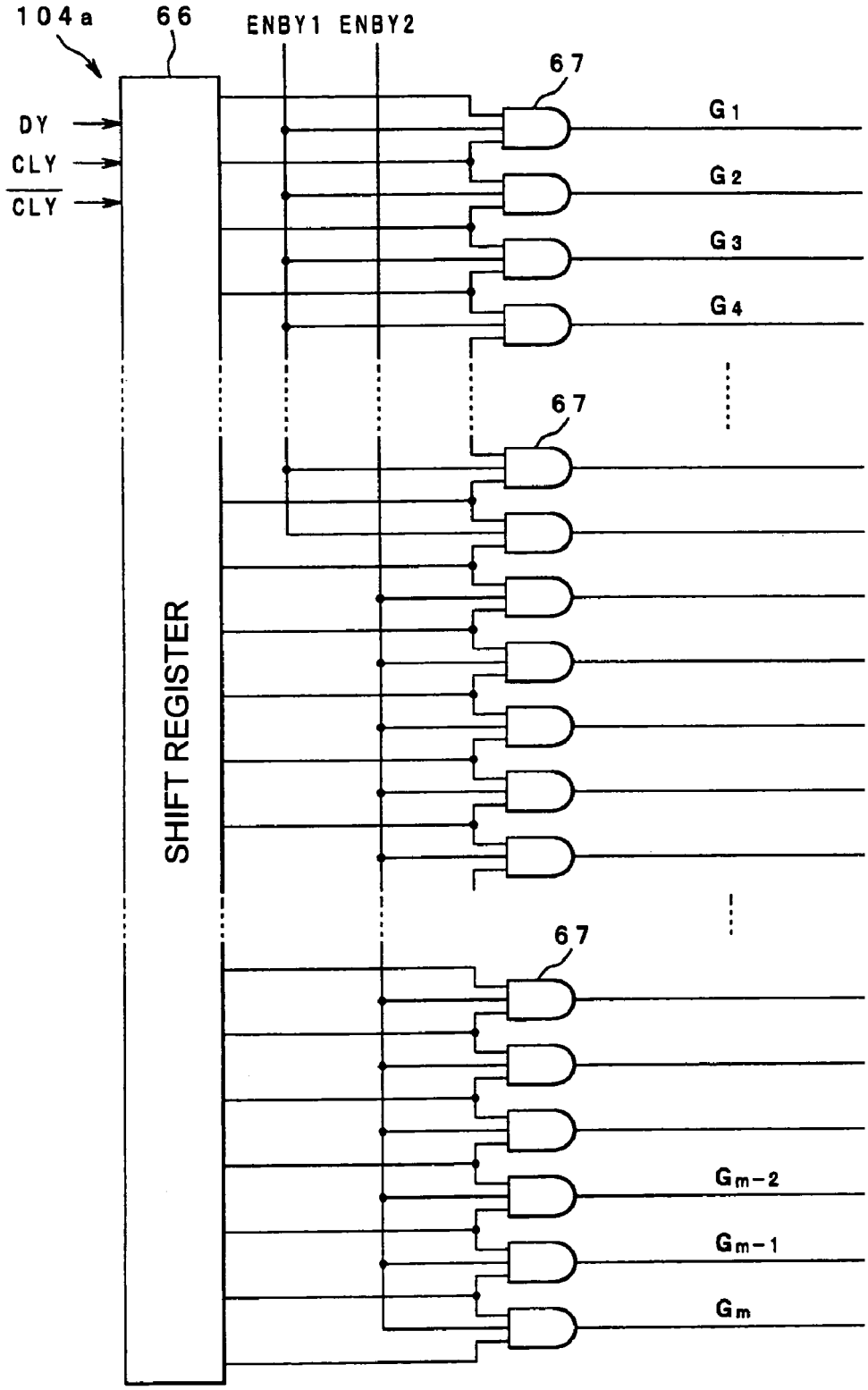
FIG. 5 is a schematic circuit diagram showing a specified configuration of a scanning driver 104*a* in FIG. 1.
Figure 6:
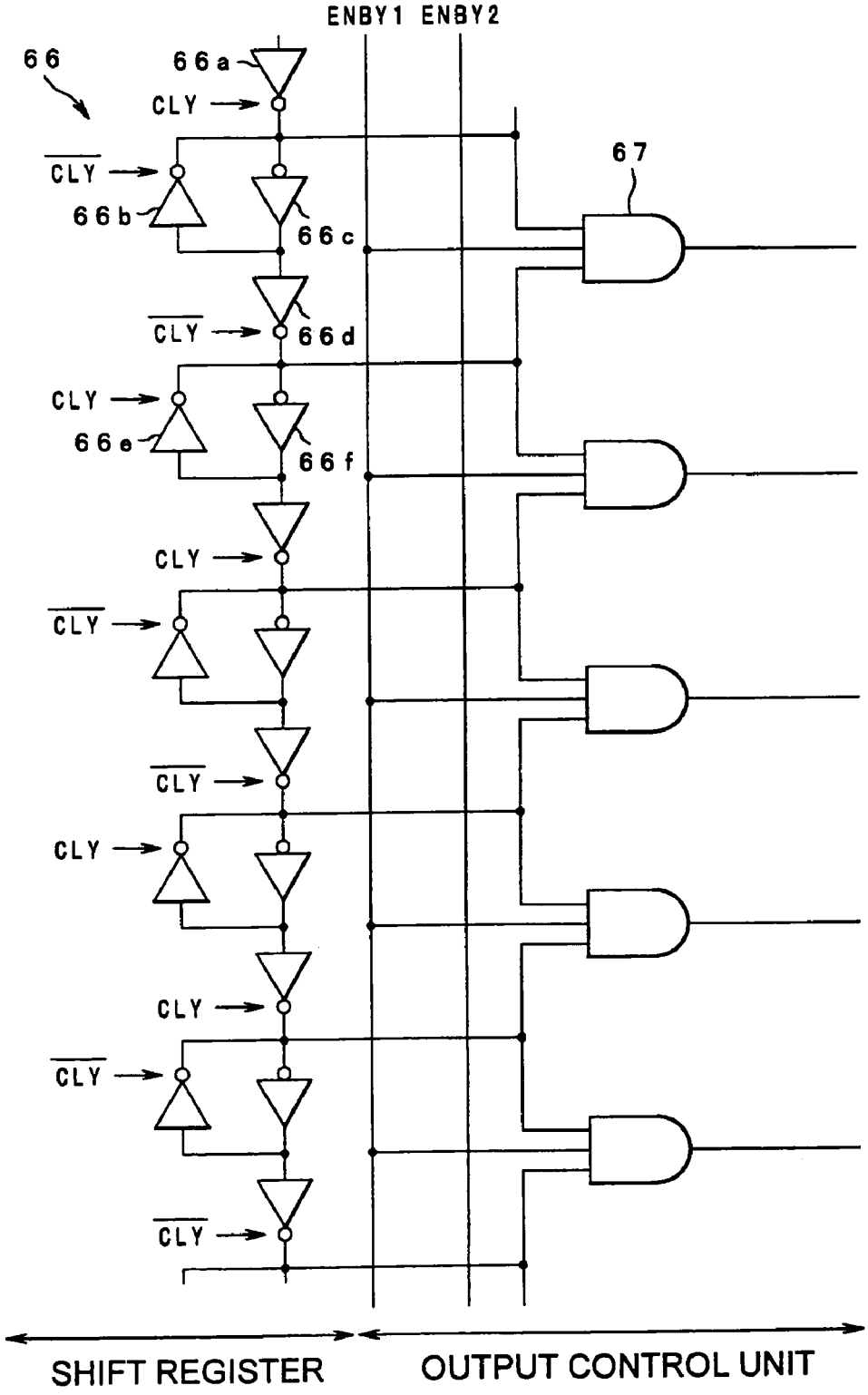
FIG. 6 is a schematic detailed circuit diagram of significant parts in FIG. 5.
Figures 7A, 7B, 7C:
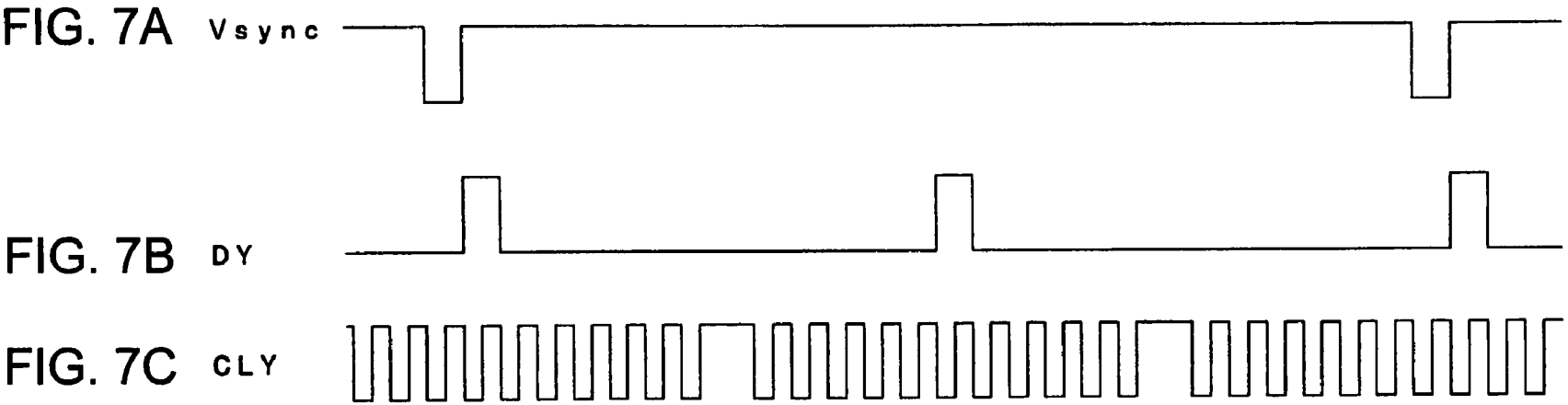
FIGS. 7A to 7C are schematic timing charts illustrating operations of the liquid crystal device.
Figures 8A, 8B, 8C, 8D, 8E, 8F, 8G, 8H, 8I, 8J, 8K, 8L:
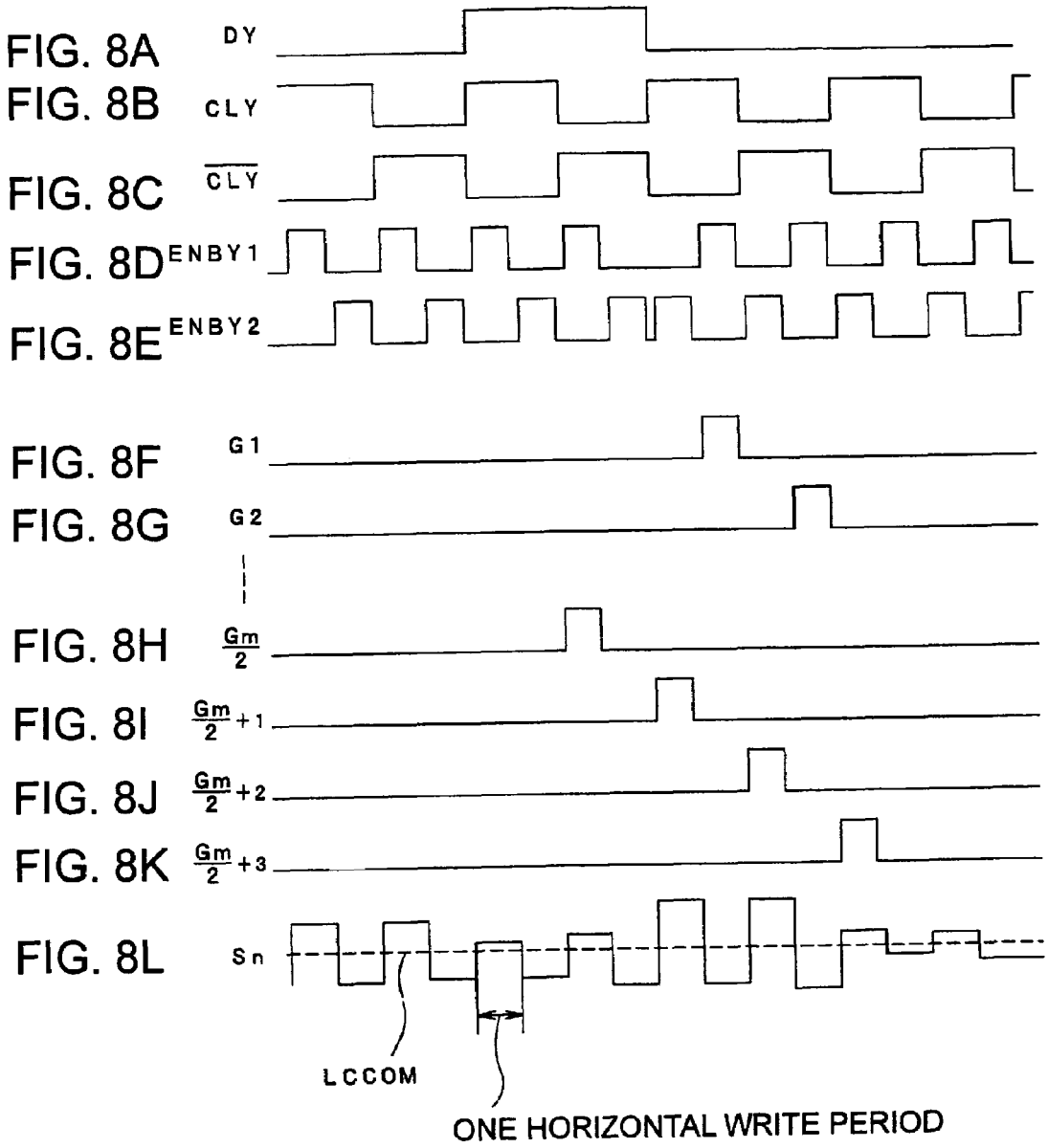
FIGS. 8A to 8L are schematic timing charts showing significant parts taken in FIGS. 7A to 7C.
Figure 9:
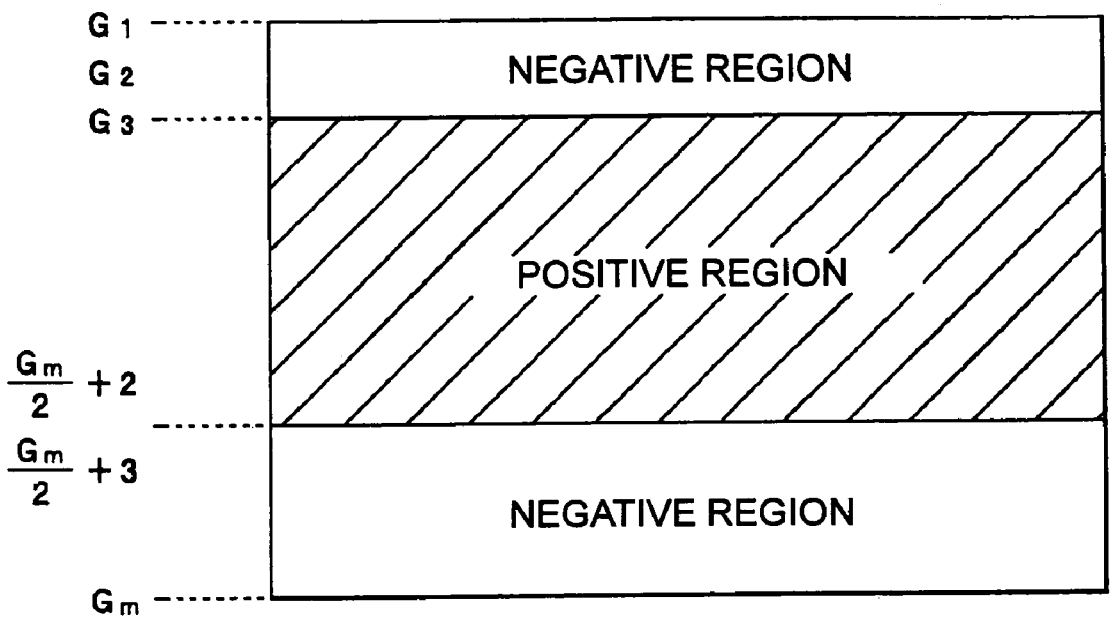
FIG. 9 is a schematic explanatory view showing an image on a screen.
Figure 10:
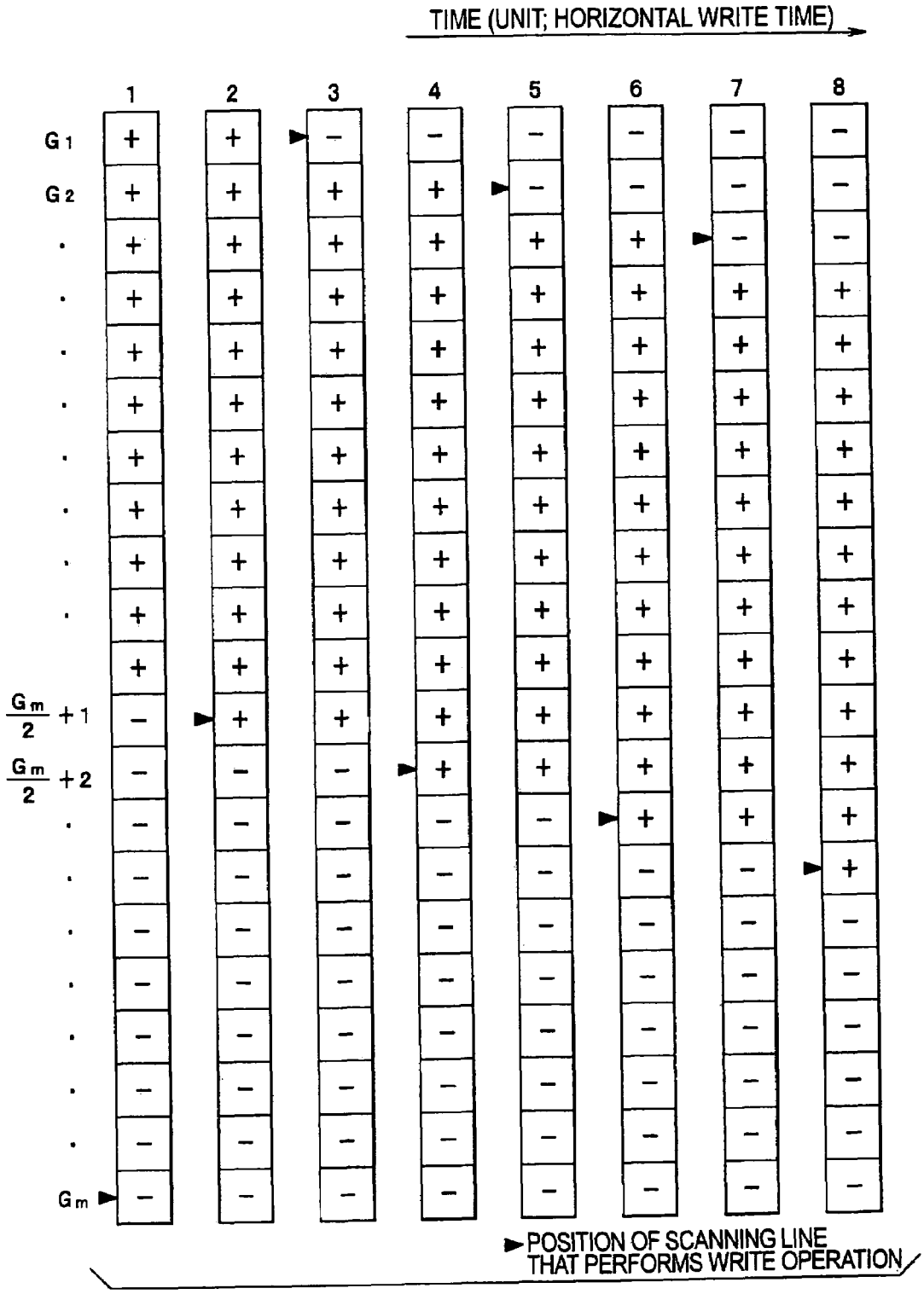
FIG. 10 is a schematic explanatory view showing an exemplary aspect of a writing (driving) operation onto the screen.
Figure 11A:
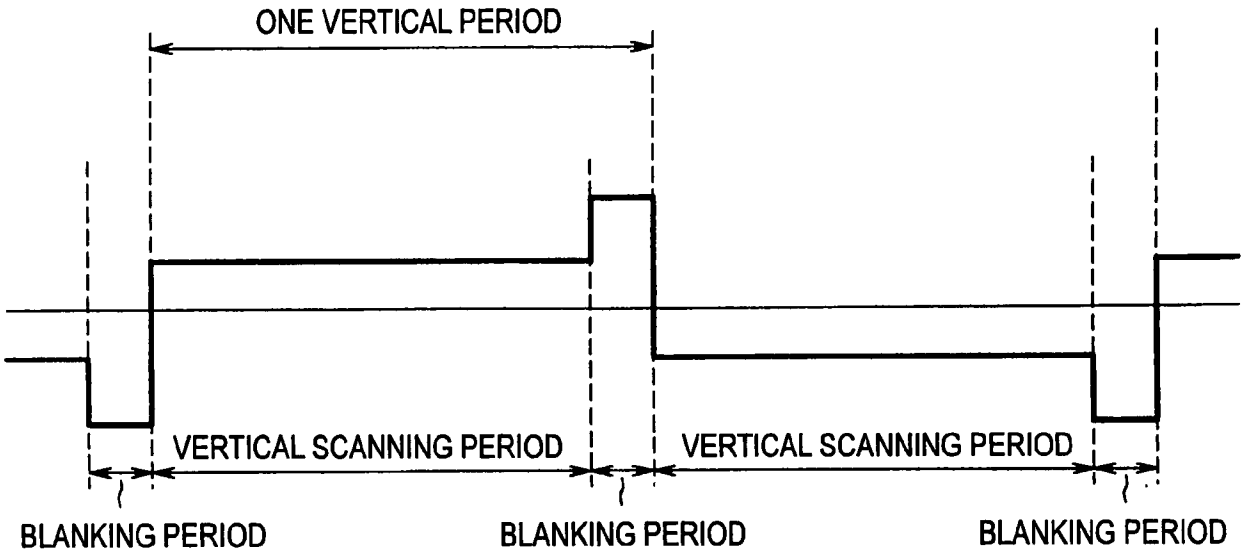
FIGS. 11A and 11B are schematic explanatory views showing an image signal of a field inversion driving system in which the image signal is inverted at each vertical period, as an example of a plane inversion driving system.
Figure 11B:
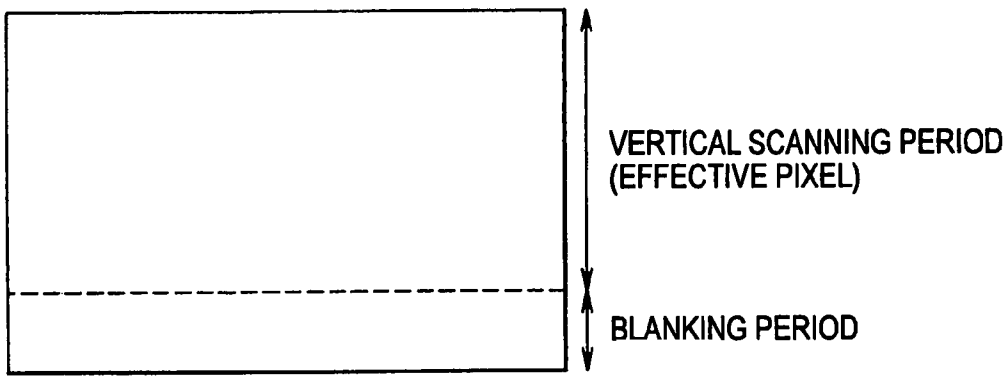
Figure 12:
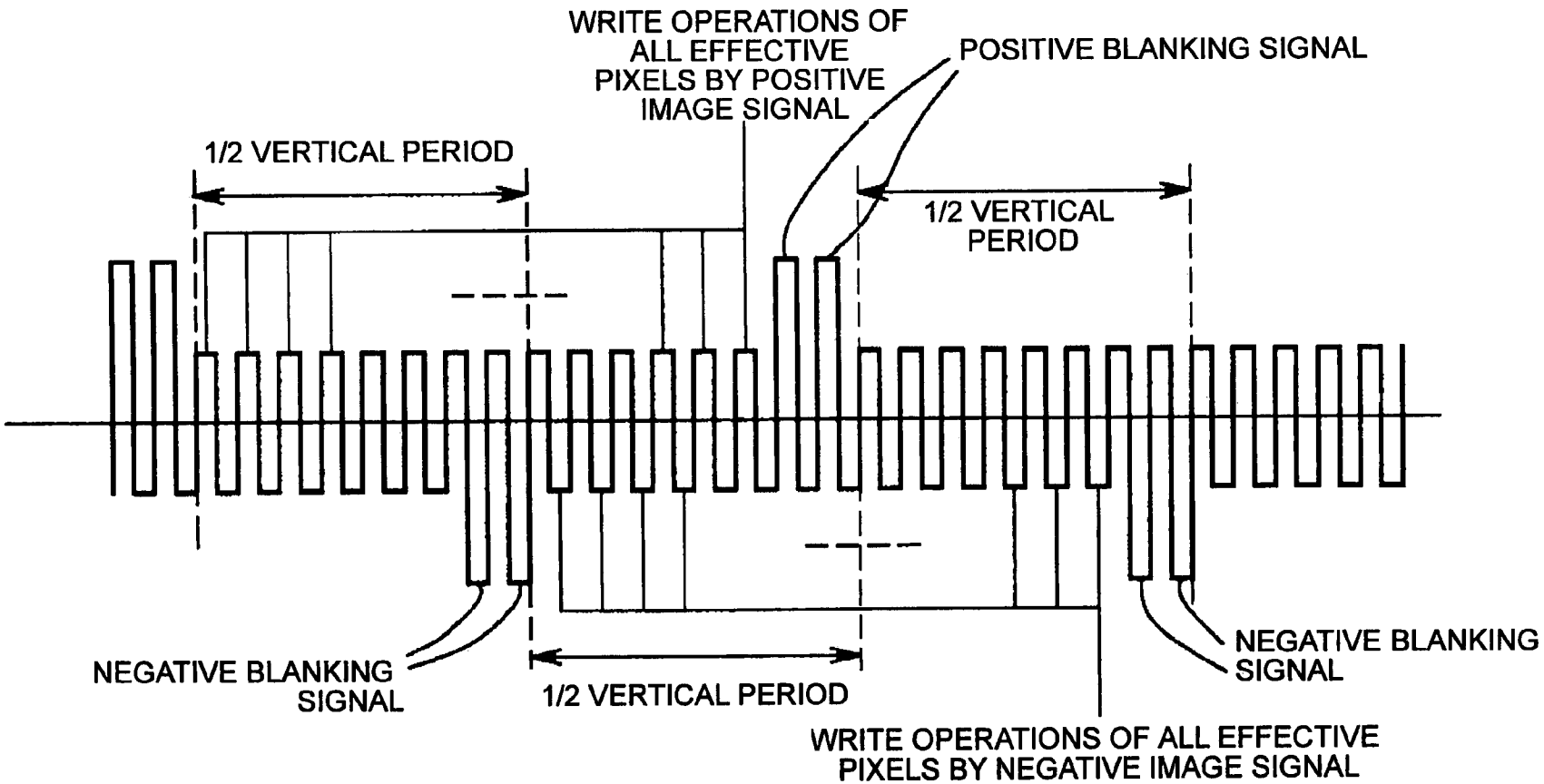
FIG. 12 is a schematic waveform diagram showing an example of an image signal waveform which is used for a region scanning inversion driving system.
Figure 13:
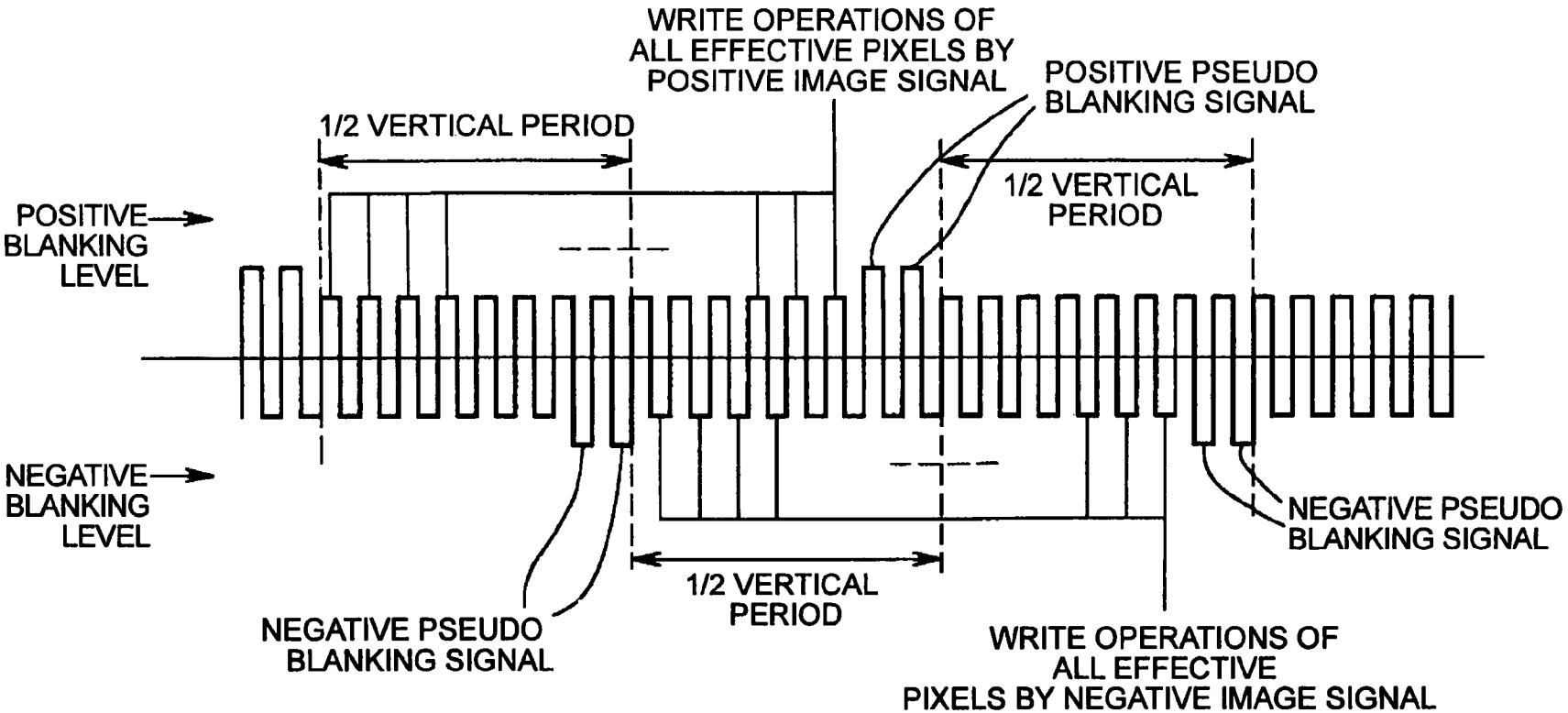
FIG. 13 is a schematic waveform diagram showing a write image in the exemplary embodiment of the present invention.
Figure 14:
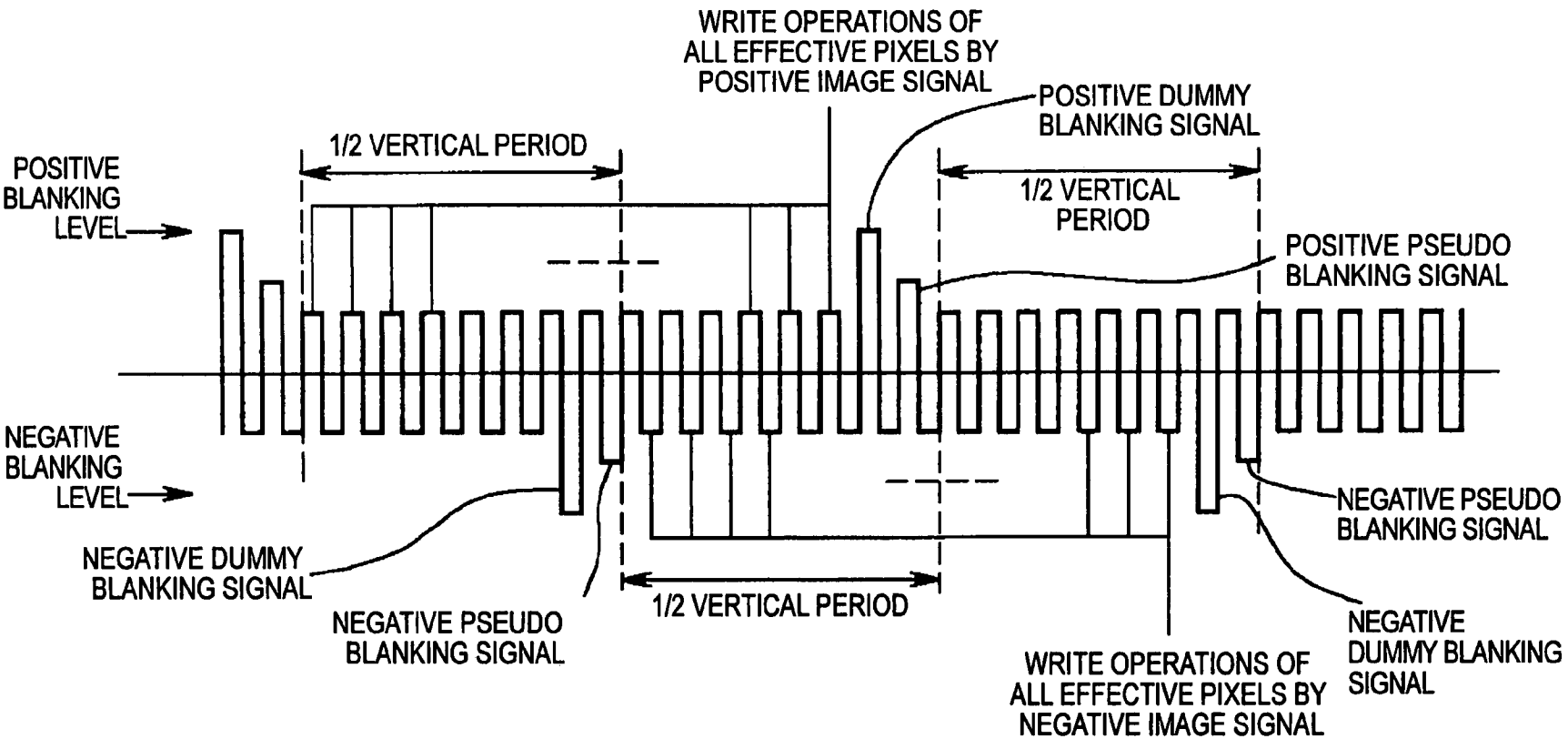
FIG. 14 is a schematic waveform diagram showing a write image when a dummy pixel formed at a periphery of an effective pixel is taken into account.

Hereinafter, exemplary embodiments of the present invention will be described in detail with reference to the drawings. FIGS. 1 to 15 relate to a first exemplary embodiment of the present invention. FIG. 1 is a schematic block diagram showing an electro-optical device according to the present exemplary embodiment. FIG. 2 is a schematic showing a configuration of a liquid crystal panel to be adapted when the present exemplary embodiment is applied to a liquid crystal device. FIG. 3 is a schematic cross-sectional view taken along the line H-H' of FIG. 2. FIG. 4 is a schematic equivalent circuit diagram of a plurality of pixels arranged in a matrix shape in a pixel region of the liquid crystal panel. FIG. 5 is a schematic circuit diagram showing a specified configuration of a scanning driver 104*a* in FIG. 1. FIG. 6 is a detailed schematic circuit diagram of significant parts in FIG. 5. FIGS. 7A to 7C are schematic timing charts illustrating operations of the liquid crystal device. FIGS. 8A to 8L are schematic timing charts showing significant parts taken in FIGS. 7A to 7C. FIG. 9 is a schematic explanatory view showing an image on a screen. FIG. 10 is a schematic explanatory view showing an exemplary aspect of a writing (driving) operation onto the screen. Further, FIGS. 11A and 11B are schematic explanatory views showing an image signal of a field inversion driving system in which the image signal is inverted at each vertical period, as an example of a plane inversion driving system. FIG. 12 is a schematic waveform diagram showing an example of an image signal waveform which is used for a region scanning inversion driving system. FIG. 13 is a schematic waveform diagram showing a write image in the present exemplary embodiment. FIG. 14 is a schematic waveform diagram showing a write image when a dummy pixel formed at a periphery of an effective pixel is taken into account. Moreover, in these drawings, each layer or each member has a different reduced scale so that each layer or each member can be fully recognized.

The present exemplary embodiment shows an example in which an electro-optical device is applied to a liquid crystal light valve, for example, used as an optical modulation device of a projection type display device.

An electro-optical device according to the present exemplary embodiment is provided with a display region 101*a* using liquid crystal as an electro-optical material, a scanning driver 104*a* and a data driver 201 which drive pixels in the display region 101*a*, a controller 61 which supplies various signals to the scanning driver 104*a* and the data driver 201, a DA converter (DAC) 64, and first and second frame memories 62 and 63.

FIG. 2 shows a schematic configuration of a liquid crystal panel 1 composed of the display region 101*a*, the scanning drivers 104*a*, and the data driver 201 in FIG. 1. FIG. 3 shows a schematic cross-sectional view thereof.

A display region 101*a* is formed at a central portion of A liquid crystal panel 1. The display region 101*a* uses a transparent substrate such as a glass substrate or the like, as an element substrate, and on the element substrate, TFTs for driving pixels, peripheral driving circuits, and so on are formed. The display region 101*a* on the element substrate is provided with a plurality of gate lines (scanning lines) G1, G2, . . . extending in an X (row) direction of FIG. 1 and a plurality of source lines (data lines) S1, S2, . . . extending in a Y (column) direction. The pixels 110 are provided at intersections of the scanning lines and the source lines respectively and are arranged in a matrix shape.

Moreover, the display region 101*a* has 1024×768 effective pixels, for example, on a basis of an XGA standard. Further, when dummy pixels are included therein, the display region 101*a* has 1044×780 pixels.

As shown in FIGS. 2 and 3, the liquid crystal panel is constructed by sealing liquid crystal 50 between a TFT substrate 10 made of, for example, a quartz substrate, a glass substrate, or a silicon substrate and a counter substrate 20 arranged to face the TFT substrate 10 and made of, for example, a glass substrate or a quartz substrate. The TFT substrate 10 and the counter substrate 20 arranged to face each other are bonded by means of a sealing member 52.

On the TFT substrate 10, pixel electrodes (ITO) 9 constituting the pixels 110 are arranged in a matrix shape. Further, on an entire surface of the counter substrate 20, a counter electrode (ITO) 21 is provided. On the pixel electrodes 9 of the TFT substrate 10, an alignment film (not shown) suffered from a rubbing treatment is provided. On the other hand, on the counter electrode 21 which is formed over the entire surface of the counter substrate 20, an alignment film (not shown) suffered from a rubbing treatment is provided. Moreover, the alignment films are made of, for example, a transparent organic film such as a polyimide film.

FIG. 4 shows an equivalent circuit diagram of elements on the TFT substrate 10 constituting the pixels. As shown in FIG. 4, in the display region 101*a*, the plurality of scanning lines G1, G2, . . . and the plurality of source lines S1, S2, . . . are wired to cross each other and the pixel electrodes 9 are arranged in a matrix shape in regions which are divided by the scanning lines G1, G2, . . . and the source lines S1, S2, . . . . And then, the TFTs 30 as switching elements are provided at intersections of the scanning lines G1, G2, . . . and the source lines S1, S2, . . . . The pixel electrodes 9 are connected to the TFTs 30 respectively.

Gates of the TFTs 30 constituting the respective pixels 110 are connected to the scanning lines G1, G2, . . . , sources thereof are connected to the source lines S1, S2, . . . , and drains thereof are connected to the pixel electrodes 9. Between the pixel electrodes 9 and the counter electrode 21, liquid crystal 50 which is an electro-optical material is interposed, thereby forming a liquid crystal layer.

To the respective scanning lines G1, G2, . . . , scanning signals G1, G2, . . . , Gm are supplied from a scanning driver 104*a* described below. Further, a counter electrode voltage is applied to the counter electrode 21. For each line, all TFTs 30 which constitute pixels of the corresponding line are simultaneously turned on by each scanning signal, and then image signals (image signals of a write image) which are supplied to the respective source lines S1, S2, . . . from a data driver 201 are written onto the pixel electrodes 9. The alignment state of molecules of liquid crystal 50 changes according to a potential difference between the pixel electrodes 9 onto which the image signals are written and the counter electrode 21, and an optical modulation is performed, thereby making it possible to display a gray-scale.

Further, storage capacitors 70 are provided parallel to the pixel electrodes 9. By each of the storage capacitors 70, the voltage on the corresponding pixel electrode 9 can be maintained for a period of time, which is, for example, three digits longer than the time when a source voltage is applied. By the storage capacitors 70, the voltage maintaining property is enhanced, so that image display can be implemented in a high contrast ratio.

Further, as shown in FIGS. 2 and 3, on the counter substrate 20, a light-shielding film 53 which is a frame for partitioning the display region is provided. In a region outside the light-shielding film 53, the sealing member 52 for sealing liquid crystal is formed between the TFT substrate 10 and the counter substrate 20. The sealing member 52 is arranged to substantially align with an outline shape of the counter substrate 20 and adheres the TFT substrate 10 and the counter substrate 20 to each other. The sealing member 52 is deleted in a portion of one side of the TFT substrate 10, such that a liquid crystal injection port 52*a* for injecting the liquid crystal 50 is formed. Into a gap between the element substrate 10 and counter substrate 20 bonded to each other, the liquid crystal is injected from the liquid crystal injection port 52*a*. After the liquid crystal is injected, the liquid crystal injection port 52*a* is sealed with a sealant 25.

In a region outside the sealing member 52, the data driver 201 which supplies the image signals to the source lines S1, S2, . . . at a predetermined timing to drive the source lines S1, S2, . . . and external connection terminals 202 for the connection with an external circuit are provided along one side of the TFT substrate 10. Along two sides adjacent to the one side, the scanning drivers 104*a* which supply the scanning signals to gate electrodes (not shown) of the TFTs 30 via the scanning lines G1, G2, . . . at a predetermined timing to drive the gate electrodes are provided. The scanning drivers 104*a* are formed along two sides of the TFT substrate 10 outside the sealing member 52. Further, on the TFT substrate 10, wiring lines 105 for connecting the data driver 201, the scanning drivers 104*a*, the external connection terminals 202, and vertical conducting terminals 107 with each other is provided along edges of the TFT substrate 10.

The vertical conducting terminals 107 are formed at four corner portions of the sealing member 52 on the TFT substrate 10. Further, vertical conducting members 106 each of which one end contacts the corresponding vertical conducting terminal 107 and the other end contacts the counter substrate 21 are provided between the TFT substrate 10 and the counter substrate 20. The vertical conducting members 106 provide electrical conduction between the TFT substrate 10 and the counter substrate 20.

A driving circuit unit 60*a* of an electro-optical device in the present exemplary embodiment has a controller 61 serving as an image rearranging unit, a frame memory of a first frame memory 62 and a second frame memory 63 for two screens, a DA converter 64, and so on, in addition to the data driver 201 and the scanning drivers 104*a* which are included in the liquid crystal panel 1, as shown in FIG. 1. One of the first frame memory 62 and the second frame memory 63 temporarily stores a video for one frame which is input from an exterior and the other is used for display. The roles of the first and second frame memory are switched over at each frame.

The controller 61 has a display device control unit 61*a* and a blanking signal processing unit 61*b* built-in. To the controller 61, a vertical synchronizing signal Vsync, a horizontal synchronizing signal Hsync, a dot clock signal dotclk and an image signal DATA of an input image are input. The controller 61 controls the first frame memory 62 and the second frame memory 63 and reads data corresponding to the scanning line for writing from the frame memory.

The display device control unit 61*a* of the controller 61 uses the memories 62 and 63, such that an image signal which is delayed for a predetermined time with respect to the image signal input from the exterior can be obtained. For example, the controller 61 can obtain image signals before and after a half of the vertical period from the input image signals. In addition, the controller 61 can synthesize the image signals before and after the half of the vertical period to convert the input image signal into a signal having a horizontal frequency larger than a horizontal frequency of the input image and can rearrange signal arrangement of the image signals according to the scanning of the display region 101*a* described below to output the rearranged image signals.

Further, as described below, in the present exemplary embodiment, at the time of reading data from the first and second frame memories 62 and 63, the blanking signal processing unit 61*b* converts a blanking signal into a predetermined gray level signal (hereinafter, referred to as a pseudo blanking signal).

The image signals from the controller 61 are supplied to the DAC 64. The DAC 64 converts the digital image signals from the controller 61 into analog signals and supplies them to the data driver 201.

Further, the controller 61 generates various signals which drive the data driver 201 and the scanning drivers 104*a*. In order to generate such various signals, the controller 61 has a timing generator (not shown). The timing generator generates various digital signals based on the vertical synchronizing signal Vsync, the horizontal synchronizing signal Hsync, and the dot clock signal dotclk supplied from outside.

That is, the controller 61 generates a transfer clock CLX which is a signal for driving the display, and so on using the timing generator, and then outputs them to the data driver 201. Further, the controller 61 generates a scanning start pulse DY, transfer clocks CLY and /CLY, and so on, and outputs them to the scanning drivers 104*a*. Moreover, the symbol/means an inversion signal, and in the drawing, it is represented by a bar on a reference numeral. Further, the controller 61 generates enable signals ENBY1 and ENBY2 and supplies them to the scanning drivers 104*a*.

The data driver 201 makes a sample and hold circuit store image signals for the number of horizontal pixels. The transfer clock CLX is a clock signal which determines a sampling timing of the sample and hold circuit corresponding to each source line. The data driver 201 outputs the image signals stored in the sample and hold circuit via the respective source lines.

The scanning start pulse DY which is generated by the controller 61 is a pulse signal which instructs the start of the scanning. In the present exemplary embodiment, the scanning start pulse DY is generated twice in one vertical period. For example, the controller 61 generates the scanning start pulses DY at the timing shifted for a half vertical period. If the scanning start pulses DY are input to the scanning driver 104*a*, the scanning drivers 104*a* output the scanning signals (hereinafter, referred to as gate pulses) (G1 to Gm) which turn on the TFTs 30 of the respective pixels to the respective scanning lines G1 to Gm.

The transfer clocks CLY and /CLY are signals which define scanning rates of a scanning side (Y side), and pulses which rise or fall corresponding to one horizontal period of the input image signal. As described below, the scanning drivers 104*a* shift the scanning line to which the gate pulse is output, in synchronization with the transfer clock CLY (/CLY).

In the present exemplary embodiment, since two scanning start pulses DY in one vertical period are generated, in display region 101*a*, for one vertical period, the gate pulses are supplied to two scanning lines which are spaced apart by the number of lines corresponding to the lag between two scanning start pulses.

At this time, there should be no case in which the TFTs 30 connected to two scanning lines are simultaneously turned on and the same image signal transferred via the source line is written onto the pixel electrodes 9 of two lines. To this end, one horizontal period is divided into a first half and a second half and the gate pulses are alternately supplied to two scanning lines in the first half and the second half of one horizontal period.

Further, the controller 61 arranges and corrects the input image signal and its delayed signal according to the above-mentioned scanning, inverts the polarities of them for every one horizontal period, and supplies them to the data driver 201. For example, the controller 61 arranges the input image signal and its delayed signal for each line to obtain the write image. That is, the image signal of the write image which is input to the data driver 201 has a transfer rate twice as fast as the image signal of the input image which is input to the controller 61. On the display panel 1, the same pixel signal is written onto the pixel electrodes 9 twice, thereby making it possible to perform a so-called double speed scanning.

That is, the horizontal period of the image signal which is input to the data driver 201 is a half h (=H/2) of the horizontal period H of the original input image signal. A write period (hereinafter, referred to as a horizontal write period) of the pixels for one line of the display region 101*a* of the liquid crystal panel 1 is aligned with the horizontal period of the write image.

One horizontal period H includes two horizontal write periods h. In each horizontal write period, the pixel signals corresponding to the image of the corresponding line are supplied to the pixels of two lines. The different pixel signals for two lines are written in two horizontal write periods h, and thus the enable signals ENBY1 and ENBY2 which rise and fall once in one horizontal period H are used.

Next, the scanning driver 104*a* will be described with reference to FIG. 5.

As shown in FIG. 5, the scanning driver 104*a* has a shift register 66 to which the scanning start pulses DY, the clock signal CLY, and the inverted clock signal/CLY are respectively input from the controller 61, and m AND circuits 67 to which an output from the shift register 66 is input. Output terminals of the AND circuits 67 are connected to the m scanning lines G1 to Gm respectively.

FIG. 6 shows a specified configuration of the shift register 66. The shift register 66 has a configuration corresponding to every two adjacent scanning lines. That is, the shift register 66 has a clocked inverter 66*a* which is conducted by the clock signal CLY and a clocked inverter 66*b* and an inverter 66*c* which are conducted by the inverted clock signal/CLY, corresponding to one scanning line of two adjacent scanning lines. Further, the shift register 66 has a clocked inverter 66*d* which is conducted by the inverted clock signal/CLY and a clocked inverter 66*e* and an inverter 66*f* which are conducted by the clock signal CLY, corresponding to the other scanning line.

The clocked inverter 66*a* is supplied with a pulse based on the scanning start pulse DY and is conducted by the clock signal CLY of 'H'. The clocked inverter 66*a* outputs its output to the corresponding AND circuit 67, an input terminal of the pre-stage AND circuit 67, and the inverter 66*c*. The inverter 66*c* outputs the inverted output of the clocked inverter 66*a* to the clocked inverter 66*b* and the next-stage clocked inverter 66*d*. The clocked inverter 66*b* is conducted by the inverted clock signal/CLY of 'H' and outputs its output to the corresponding AND circuit 67 and the input terminal of the pre-stage AND circuit 67.

Further, when receiving the clock signal CLY of 'H', the clocked inverter 66*d* outputs the output of the pre-stage inverter 66*c* to the corresponding AND circuit 67, the input terminal of the pre-stage AND circuit 67, and the inverter 66*f*. The inverter 66*f* outputs the inverted output of the clocked inverter 66*d* to the clocked inverter 66*e* and the next-stage clocked inverter 66*a*. The inverter 66*f* is conducted by the inverted clock signal/CLY of 'H' and supplies its output to the corresponding AND circuit 67 and the input terminal of the pre-stage AND circuit 67.

The scanning start pulse DY which is input to the clocked inverter 66*a* is a pulse having a predetermined width, and the pulse based on the scanning start pulse DY is sequentially transferred to the respective AND circuits 67 via the clocked inverter 66*a*, the inverter 66*c*, the clocked inverter 66*d*, and the inverter 66*f*. Further, the output of the clocked inverter 66*b* is supplied to the AND circuits 67, and thus the rising and falling of the output pulse of each of the AND circuits 67 are defined by the clock signal CLY.

In addition, the AND circuits 67 are also supplied with the enable signals ENBY1 and ENBY2. For example, the AND circuits 67 which correspond to odd-numbered scanning lines are supplied with the enable signal ENBY1 and the AND circuits 67 which correspond to even-numbered scanning lines are supplied with the enable signal ENBY2. The AND circuits 67 calculate a logical sum of three inputs and output it to the respective scanning lines as a scanning signal. Accordingly, the pulse width of the gate pulse is aligned with the pulse width of each of the enable signals ENBY1 and ENBY2. The pulse width is the horizontal write period.

Next, operations of the driving circuit unit 60*a* will be described in detail with reference to FIGS. 7A to 7C and 8A to 8L.

As shown in FIGS. 7A to 7C, in the driving circuit unit 60*a*, the scanning start pulse DY is output twice in one vertical period of the input image signal. The scanning start pulse DY is shifted by the shift register 66 of the scanning driver 104*a* according to the clock signal CLY of one horizontal period in which one pulse rises and falls for every one horizontal write period.

Since two scanning start pulses DY are generated in one vertical period, for example, the gate pulses of 'H' which are generated from the AND circuits 67 of the respective scanning lines based on the first scanning start pulse are shifted to a next stage at the horizontal period H of the input image signal. The pulse width of each of the gate pulses is defined by the 'H' period of each of the enable signals ENBY1 and ENBY2. Further, the gate pulses of 'H' which are generated from the AND circuits 67 of the respective scanning lines based on the second scanning start pulse DY are shifted to a next stage at the horizontal period H of the input image signal. The pulse width of each of the gate pulses is defined by the 'H' period of each of the enable signals ENBY1 and ENBY2 (see FIGS. 8D to 8K).

As such, the gate pulses are alternately output to two positions on the screen, which is divided by the m scanning lines, in one horizontal period H (see FIGS. 8F to 8K). In a next one horizontal period H, the gate pulses are generated for next scanning lines respectively. That is, the gate pulses are sequentially output to a predetermined scanning line, a scanning line spaced apart by m lines from the predetermined scanning line, a next-stage scanning line to the predetermined scanning line, a scanning line spaced apart by m lines from the scanning line, and a next-stage scanning line to the scanning line (that is, in an order of the scanning line G1, the scanning line (Gm/2)+1, the scanning line G2, the scanning line (Gm/2)+2, the scanning line G3, . . . ).

As such, by using the scanning start pulse DY and the enable signals ENBY1 and ENBY2, the horizontal write period of the liquid crystal panel 1 can be set to an approximately half of the horizontal period H of the input image signal.

On the other hand, the polarity of a data signal Sx output from the data driver 201 is inverted into positive or negative for every one horizontal write period h on a basis of a common potential LCCOM. Therefore, while the polarity of the data signal Sx is inverted for every one horizontal write period, the gate pulses are alternately output to two positions on the screen, which is divided by the m scanning lines, in the above-mentioned order. As a result, as shown in FIG. 9, in any one horizontal period, for example, dots corresponding to the scanning lines G3 to (Gm/2)+2 on the screen become a region (hereinafter, simply referred to as a positive region) in which data having positive potential is written. Further, dots corresponding to the scanning lines G1 to G2 and (Gm/2)+3 to Gm on the screen become regions (hereinafter, simply referred to as negative regions) in which data having negative potential is written. That is, it seems as if the screen is divided into three regions of the positive region and the negative regions, in which data having different polarities is written.

FIG. 9 is a schematic showing an image on the screen at the moment of any one horizontal period, and FIG. 10 is a schematic showing a state of a change in polarity on the screen as the time passes. When a horizontal axis of FIG. 10 is the time (unit; one horizontal write period), for example, in a first horizontal write period, data having a negative potential is written into dots corresponding to the scanning line Gm. And then, in a second horizontal write period, data having a positive potential is written into dots corresponding to the scanning line (Gm/2)+1, into which data having the negative potential was written in the first horizontal write period. Further, in a next third horizontal write period, data having a negative potential is written into dots corresponding to the scanning line G1, into which data having the positive potential was written before the ½ vertical period.

Therefore, the positive region and the negative region respectively move by one line for every one horizontal write period, and when the scanning line moves the half of the screen, the positive region and the negative region are completely inverted. That is, a rewrite operation for one screen is performed. The rewrite of the screen is performed at the ½ vertical period, and in one vertical period, the respective pixels can be rewritten once more. That is, according to this method, the scanning line moves the entire screen, and thus the rewrite operation can be performed twice.

As described above, the image signal input to the data driver 201 is arranged to have the transfer rate twice as fast as the same image before and after the predetermined period (the ½ vertical period in the example of FIG. 10). As a result, the same image is written onto the respective pixels of the liquid crystal panel 1 twice in one vertical period, which making it possible to perform the so-called double speed scanning.

As such, in the present exemplary embodiment, one vertical period is shifted by the predetermined period to start write operations twice, and thus the gate pulses are supplied to two scanning lines in one horizontal period. And then, in this case, by using the enable signals, the gate pulses are alternately supplied to the scanning lines for every horizontal period which is the half of one horizontal period, thereby performing the write operations to the pixels. For example, the same image signal is shifted by the ½ vertical period and is overwritten twice to the respective pixels. That is, while coming and going, jumping over a portion (a plurality) of the scanning lines, twice scanning operations are performed over all the scanning lines in one vertical period. Thus, at a certain timing, a plurality of regions occur in which a positive potential application region and a negative potential application region exist corresponding to the respective fields within the screen. Hereinafter, such a driving method is called a region scanning inversion driving method.

By the way, as described above, the liquid crystal panel conventionally uses a line inversion system and a plane inversion system in which a polarity is inverted at a field period or the like simultaneously. FIGS. 11A and 11B show an image signal of a field inversion driving system in which the polarity of the image signal is inverted at every one vertical period, as an example of the plane inversion driving system. FIG. 11A shows a waveform of an image signal of two vertical periods, and FIG. 11B shows a relationship between the waveform of the image signal in FIG. 11A and the position on the screen.

As shown in FIG. 11, the polarity of the image signal is inverted at every one vertical period. In an end edge of one vertical period, a blanking period is set. FIG. 11A shows an example of a normally white mode. The level of a signal (blanking signal) of the blanking period is a black level which is the highest level. FIG. 11B corresponds to the display region 101*a*, in which a region corresponding to the vertical scanning period is a region of effective pixels. To the contrary, in a region of the blanking period, effective pixels do not exist on the display region 101*a*, and thus the write operation to the pixel by the blanking signal is not performed. In general, by using the blanking period, a next screen is ready to be displayed.

To the contrary, FIG. 12 shows an example of an image signal waveform which is used for the above-mentioned region scanning inversion driving system. One horizontal write period is represented by one positive or negative pulse and the image signal level is represented by the amplitude. Moreover, in FIG. 12, for simplicity, the number of pulses (the number of horizontal periods) in the vertical period is shown smaller than the actual number of pulses.

By the positive image signal of one vertical period including the blanking period, the write operations of all the effective pixels are performed and next write operations are prepared. Further, by the negative image signal of one vertical period including the blanking period, the write operations of all the effective pixels are performed and next write operations are prepared. In such a manner, as described above, write operations by the same image are performed twice in one vertical period.

As described above, two scanning start pulses are generated in one vertical period, and thus, as shown in FIG. 12, between the write operation based on the initial scanning start pulse DY and the write operation based on the next scanning start pulse, for example, the time difference is only the ½ vertical period. For example, if the positive image signal is written based on the first scanning start pulse DY, the negative image signal is written based on the next scanning start pulse. As described above, the write operations are performed in different horizontal write periods from each other.

The write operation by the positive image signal and the write operation by the negative image signal which are deviated by the ½ vertical period are simultaneously performed with the deviation of the horizontal write period. Thus, as shown in FIG. 12, the blanking period appears in the ½ vertical period. In the blanking period, a black level signal having a polarity (blanking signal) and the image signal having an opposite polarity are supplied to the pixels together. That is, in the region scanning inversion driving system, at the time of the blanking period having a polarity, the write operation is performed by the image signal having an opposite polarity. In the blanking period, the blanking signals having the same polarity and the highest level are applied to the source lines at an interval of the horizontal write period. Between the blanking signals, the write operation is performed by the image signal having an opposite polarity and a predetermined level.

As such, since the signals having the same polarity and the high level are repetitively supplied to the source lines at an interval of the short time in the blanking period, the potential on the source line in the blanking period is largely affected by the level of the image signal and the blanking signal due to the wiring capacitance of the source line. That is, in the blanking period, the blanking signal having the high black level appears as a ghost. In particular, in a gray level, display quality deteriorates.

For this reason, in the present exemplary embodiment, the level of the blanking signal is varied to have an optimal value suitable for the gray level. FIG. 13 is a waveform diagram of such a write image.

As shown in FIG. 13, in the blanking period, any of the positive blanking signal and the negative blanking signal is set to a pseudo blanking signal having a level lower than the black level blanking signal.

The blanking signal processing unit 61*b* in the controller 61 is controlled by the display control unit 61*a* and converts the blanking signal of the input image read from the first or second frame memory 62 or 63 into the pseudo blanking signal to output it. For example, the controller 61 can detect the blanking signal by counting the number of pixel data read on a basis of the vertical synchronizing signal. In this case, the blanking signal processing unit 61*b* outputs the pseudo blanking signal, instead of the blanking signal, at the detection timing of the blanking signal. Further, when the image signal is read, the blanking signal processing unit 61*b* may assign an address in which the pseudo blanking signal is stored, instead of an address of the frame memory 62 or 63 which is assigned as a destination of the blanking signal, thereby outputting the pseudo blanking signal instead of the blanking signal.

In the present exemplary embodiment, the blanking signal processing unit 61*b* outputs the pseudo blanking signal having transmittance of 60±20%, instead of the blanking signal having a black level of transmittance of 0 (zero). Alternatively, when the image signal is represented by 256 gray-scale levels (8 bits), the blanking signal processing unit 61*b* may output the pseudo blanking signal of a gray-scale level of 200±30. Moreover, the level of the pseudo blanking signal which can reduce the ghost to the minimum varies according to the horizontal write period, the signal level of the write image, or the like. For this reason, the level range of the pseudo blanking signal has a margin.

In such a manner, in the blanking period, the pseudo blanking signal having a relatively low level is supplied to the source line at the interval of the horizontal write period. Thus, an influence of the pseudo blanking signal having a polarity on the write operation of the image signal having an opposite polarity adjacent thereto can be drastically reduced. As a result, the ghost in the blanking period is reduced or prevented, thereby enhancing display quality.

FIG. 14 is a waveform diagram illustrating a signal level of the blanking period when a dummy pixel arranged at periphery of the effective pixel is taken into account. In general, two pixels arranged at the periphery of the effective pixel are set to the dummy pixels. In the exemplary example of FIG. 14, in order to perform compact image display, the dummy pixels are set to have a high black level.

As shown in FIG. 14, the dummy pixels adjacent to the effective pixel are set to dummy blanking signals having the same level as that of the original blanking signal. Moreover, in FIG. 14, for simplicity, the write operation of the dummy blanking signal is performed only in one horizontal write period. However, it should be understood that the write operation of the dummy blanking signal is performed for the number of the dummy pixels. Further, in the blanking period after the dummy pixels, similar to FIG. 13, the pseudo blanking signal of a predetermined gray level is set.

In such a manner, the influence of the ghost due to the blanking signal can be suppressed. Further, by supplying the dummy pixels with a sufficiently high black level, compact display can be realized.

As such, in the present exemplary embodiment, the positive region and the negative region each of which has an area of a half of the screen are inverted at one vertical period, and thus the plane inversion driving is performed for every region. In one vertical period, adjacent bits have opposite polarities for the horizontal write period but the same polarity for remaining most time, such that disclination does not almost occur. On the other hand, as shown in the signal waveform Sn of FIG. 8L, the signals having the same polarities as those in the related art line inversion driving are transferred to the source lines S1, S2, . . . . Thus, there is little difference in a potential relationship between the pixel electrode and the data line in a time manner at pixels of an upper side and a lower side of the screen, unlike the related art plane inversion system. Therefore, crosstalk can be suppressed and non-uniformity of display according to the positions on the screen can be reduced or avoided.

Further, in the present exemplary embodiment, in the blanking period, the pseudo blanking signal having the predetermined gray level lower than the black level is used. Thus, the influence of the ghost due to the blanking signal can be reduced. In particular, in the gray level, display quality can be enhanced.

Next, a second exemplary embodiment of the present invention will be described.

Figure 15:
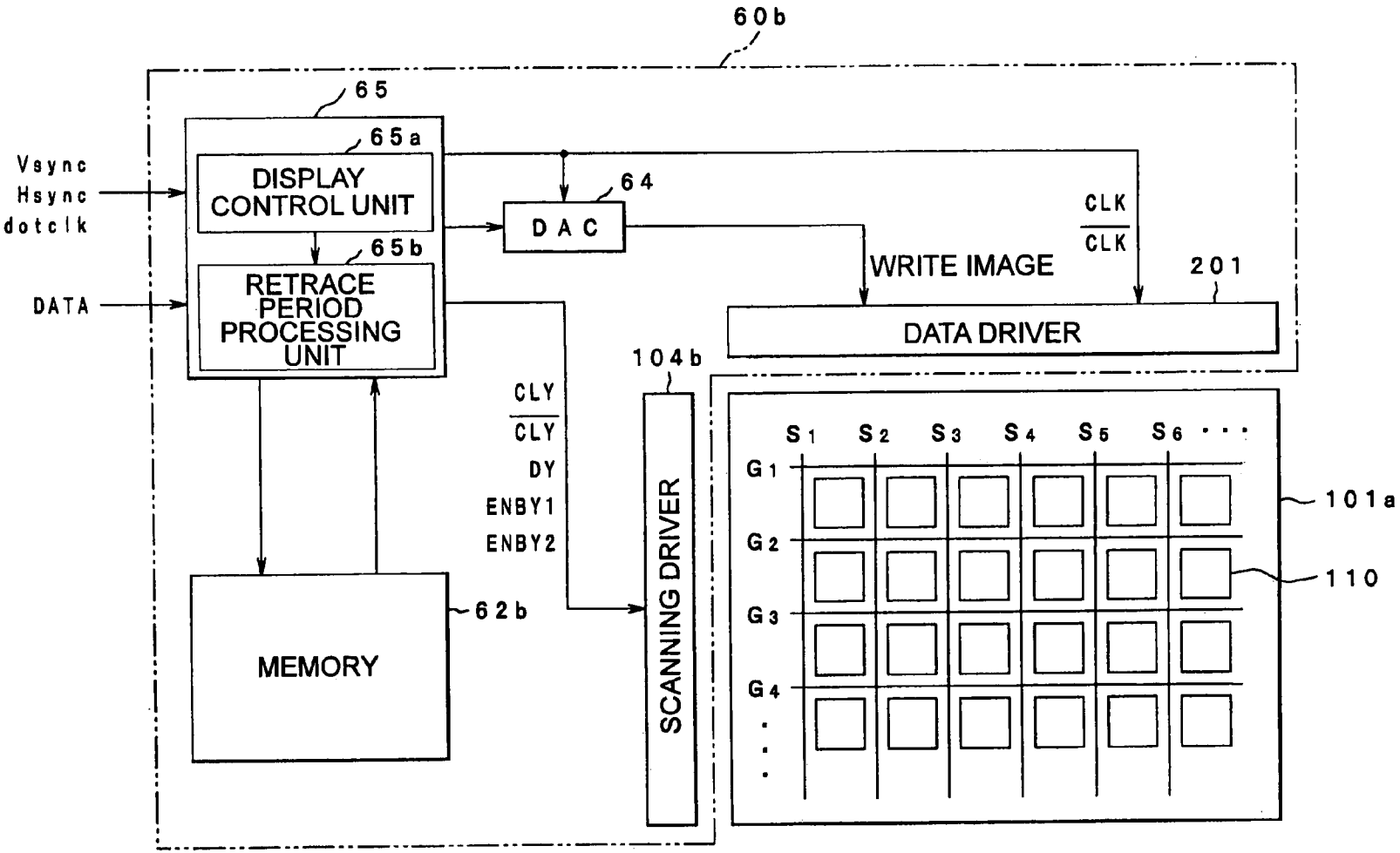
FIG. 15 is a schematic block diagram showing an electro-optical device according to a second exemplary embodiment of the present invention.

FIGS. 15 to 24 relate to the second exemplary embodiment of the present invention. FIG. 15 is a schematic block diagram showing an electro-optical device according to a second exemplary embodiment of the present invention.

Figure 16:
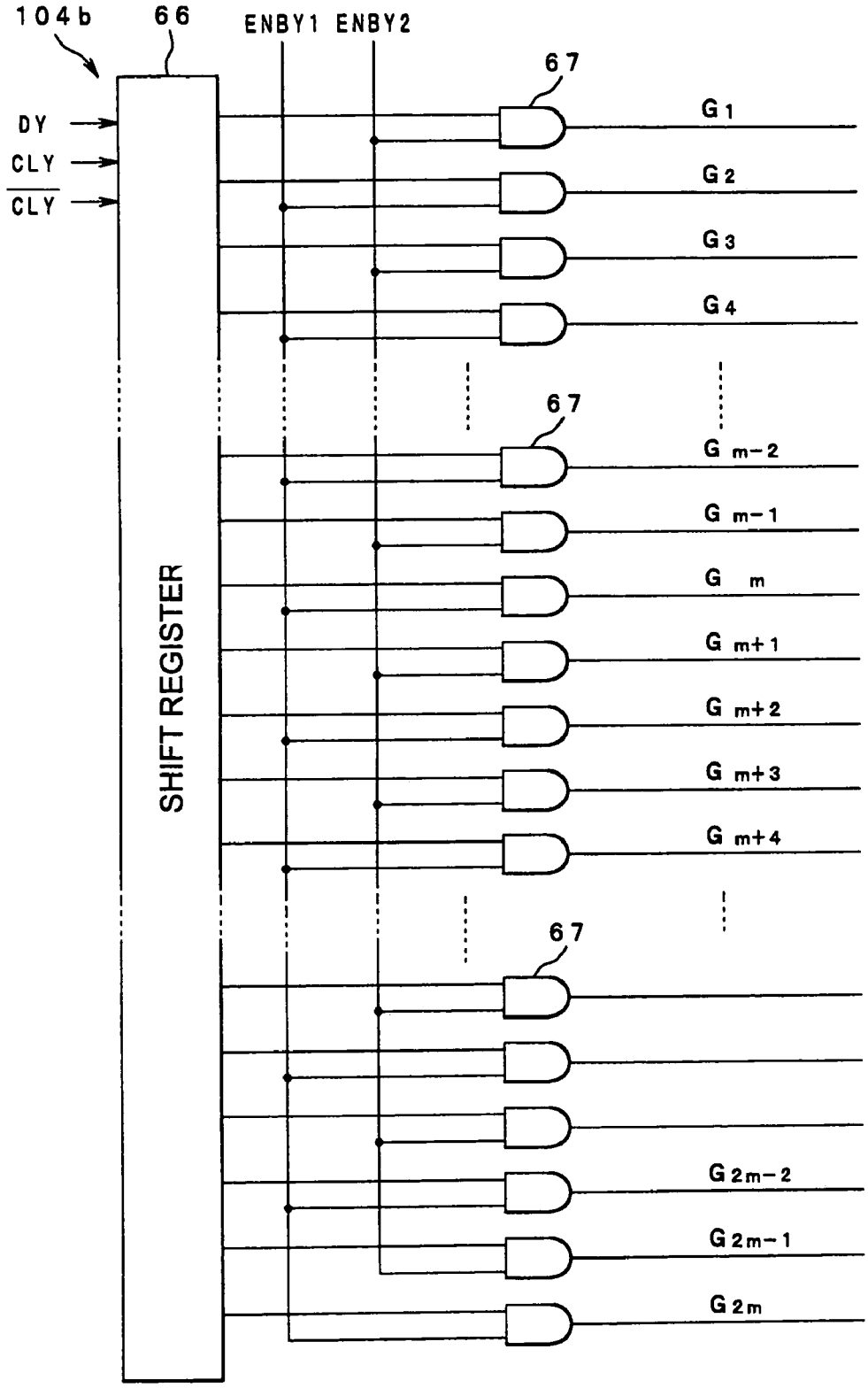
FIG. 16 is a schematic circuit diagram showing a specified configuration of a scanning driver 104*a* in FIG. 15.
Figure 17:
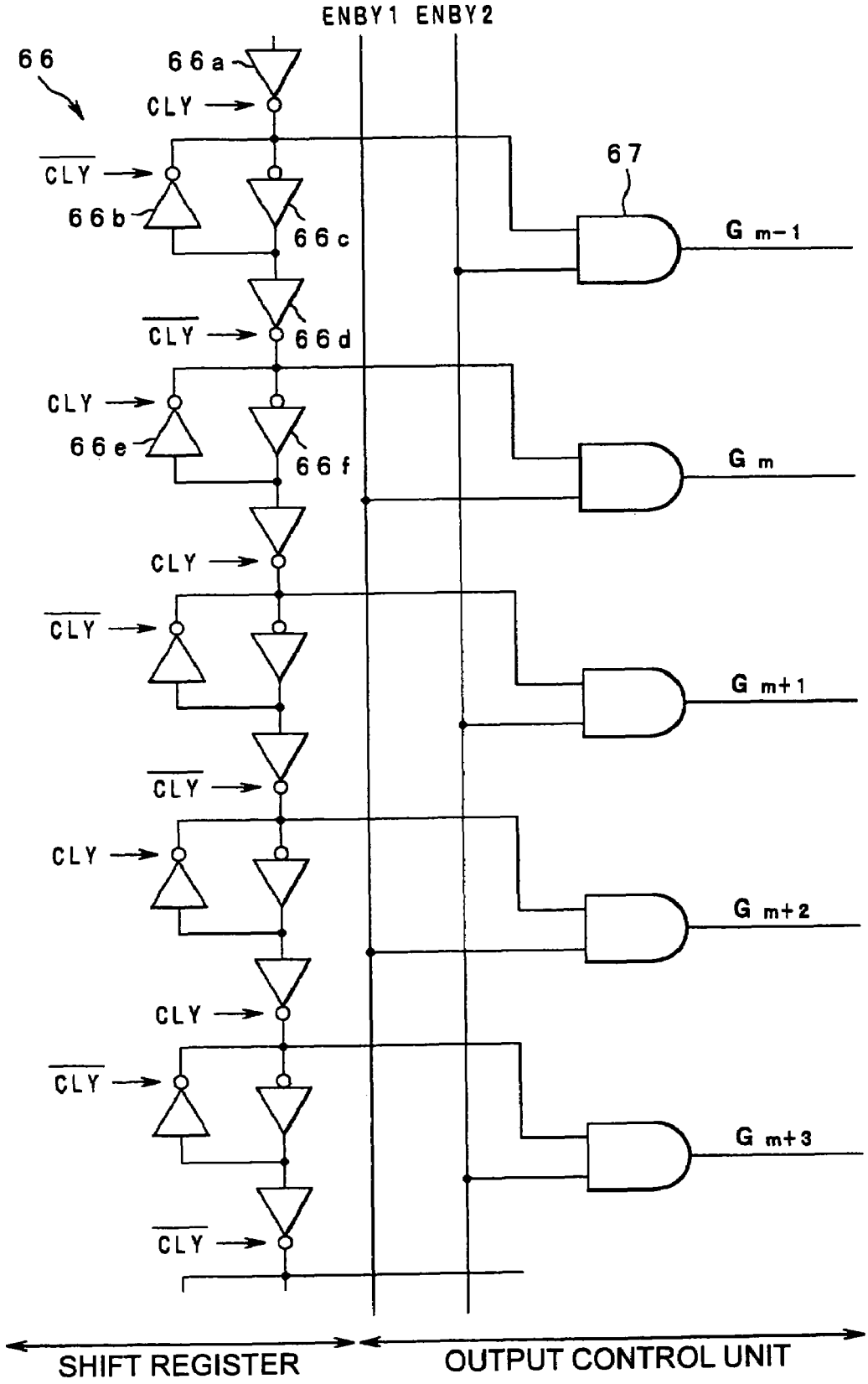
FIG. 17 is a schematic detailed circuit diagram of significant parts in FIG. 16.
Figures 18A, 18B, 18C, 18D, 18E, 18F, 18G, 18H, 18I, 18J, 18K, 18L:
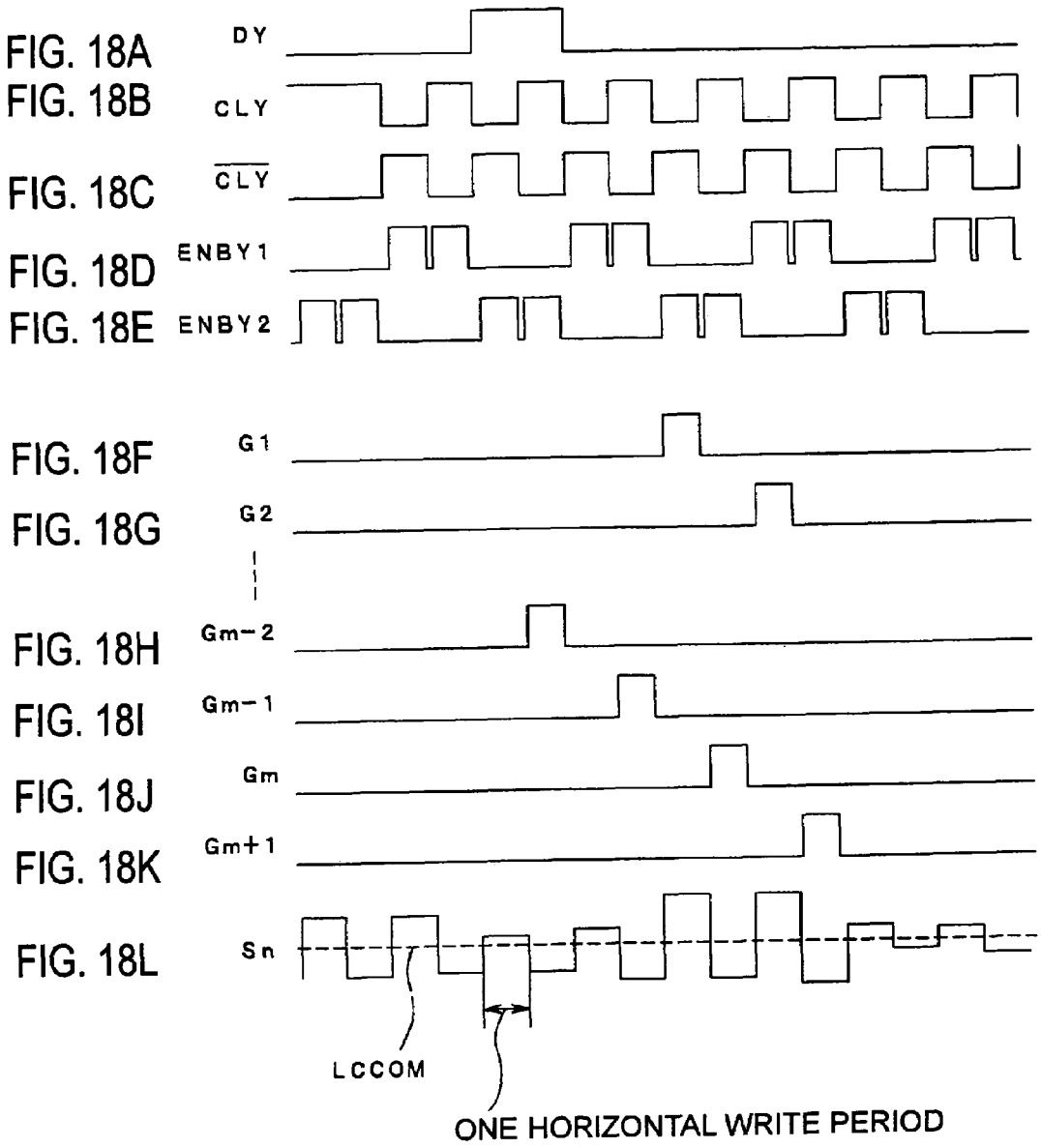
FIGS. 18A to 18L are schematic timing charts illustrating scanning in the exemplary embodiment of the present invention.
Figure 19:
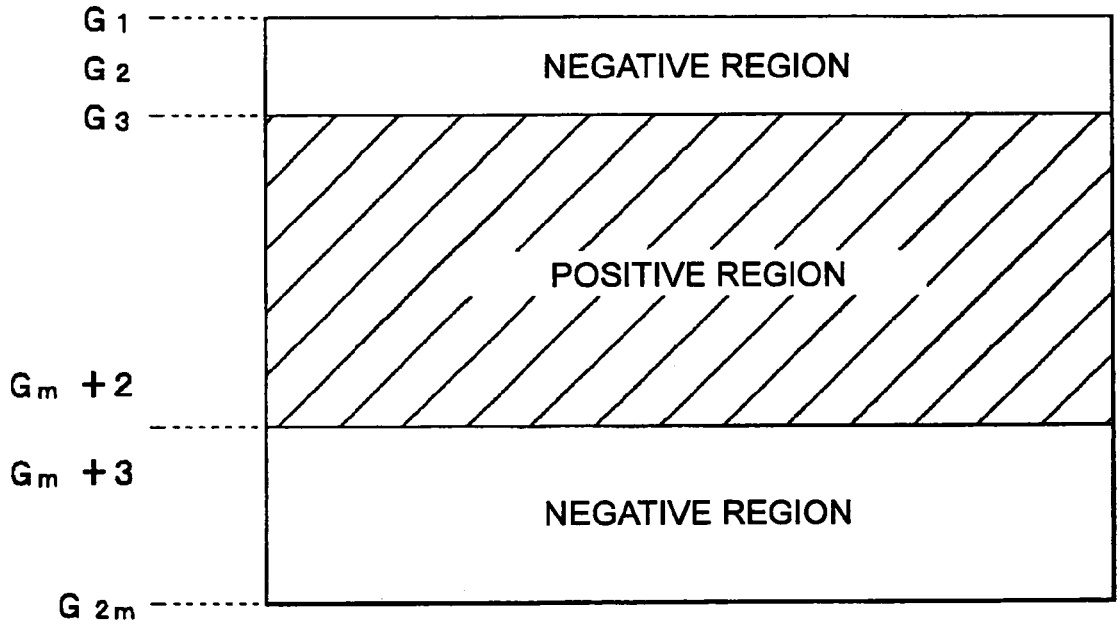
FIG. 19 is a schematic showing an image on a screen.
Figure 20:
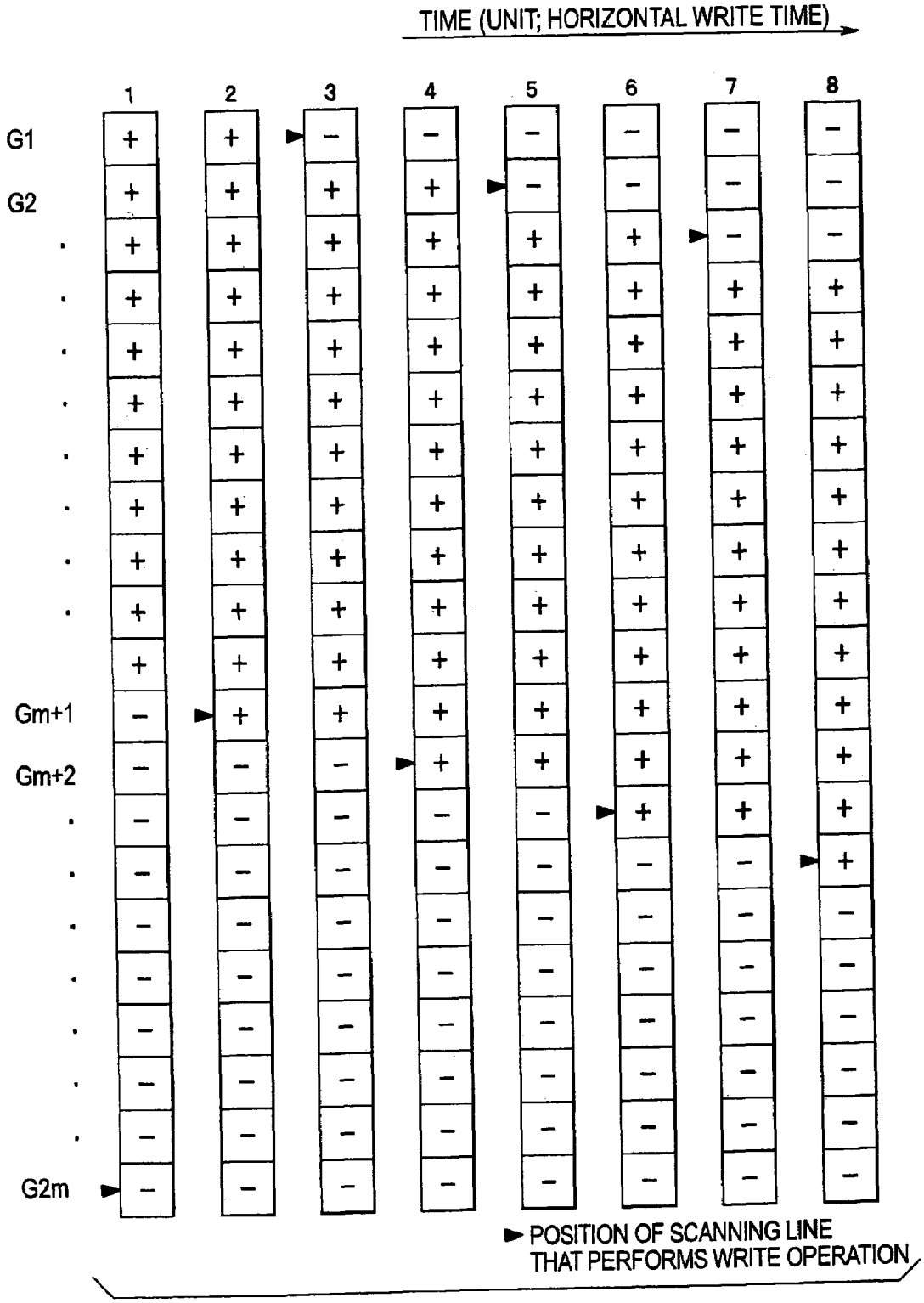
FIG. 20 is a schematic showing an exemplary aspect of a writing (driving) operation onto the screen.
Figure 21:
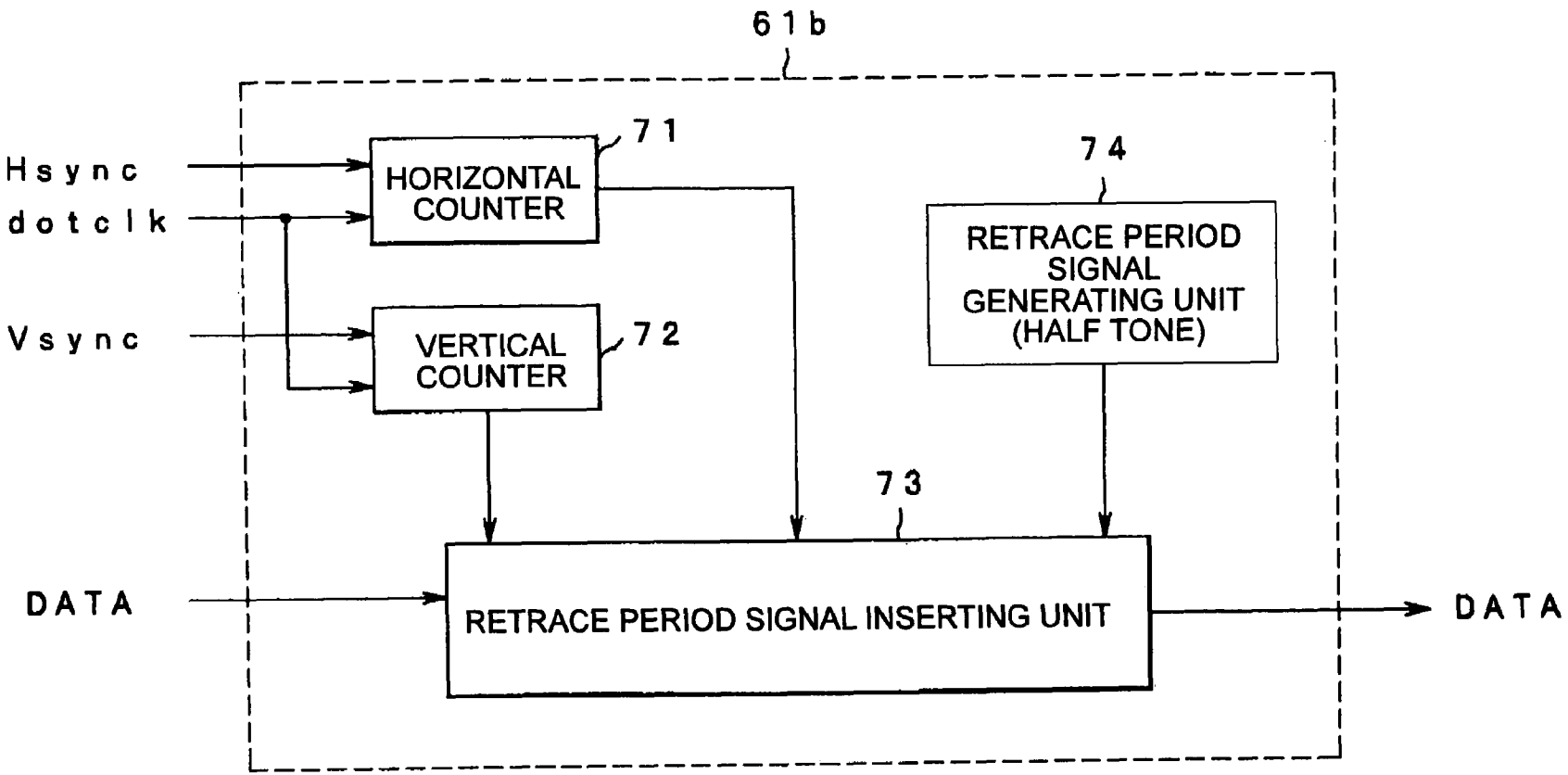
FIG. 21 is a schematic showing a specified configuration of a retrace period processing unit 61*b* in FIG. 15.
Figures 23A, 23B, 23C, 23D:
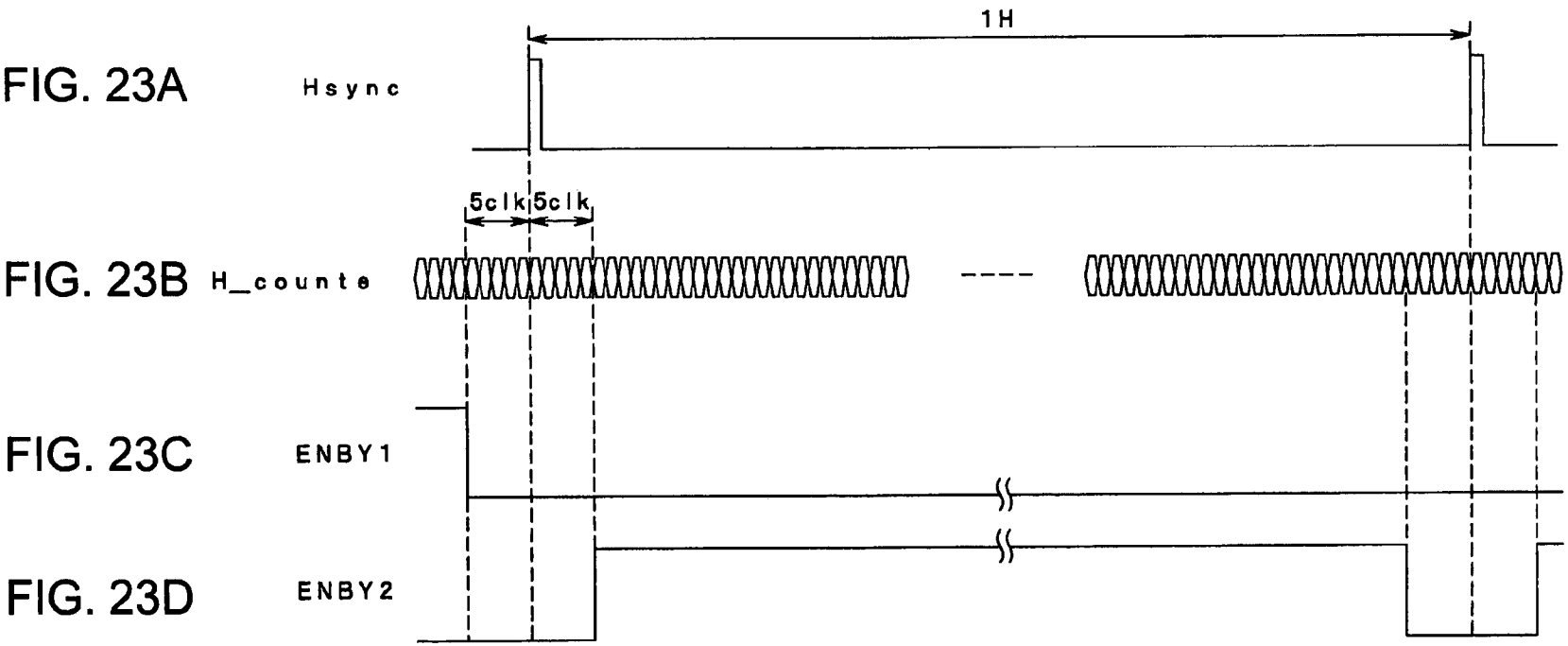
FIG. 23A to 23D are timing charts illustrating an example of a creation method of the enable signals ENBY1 and ENBY2.
Figure 24:
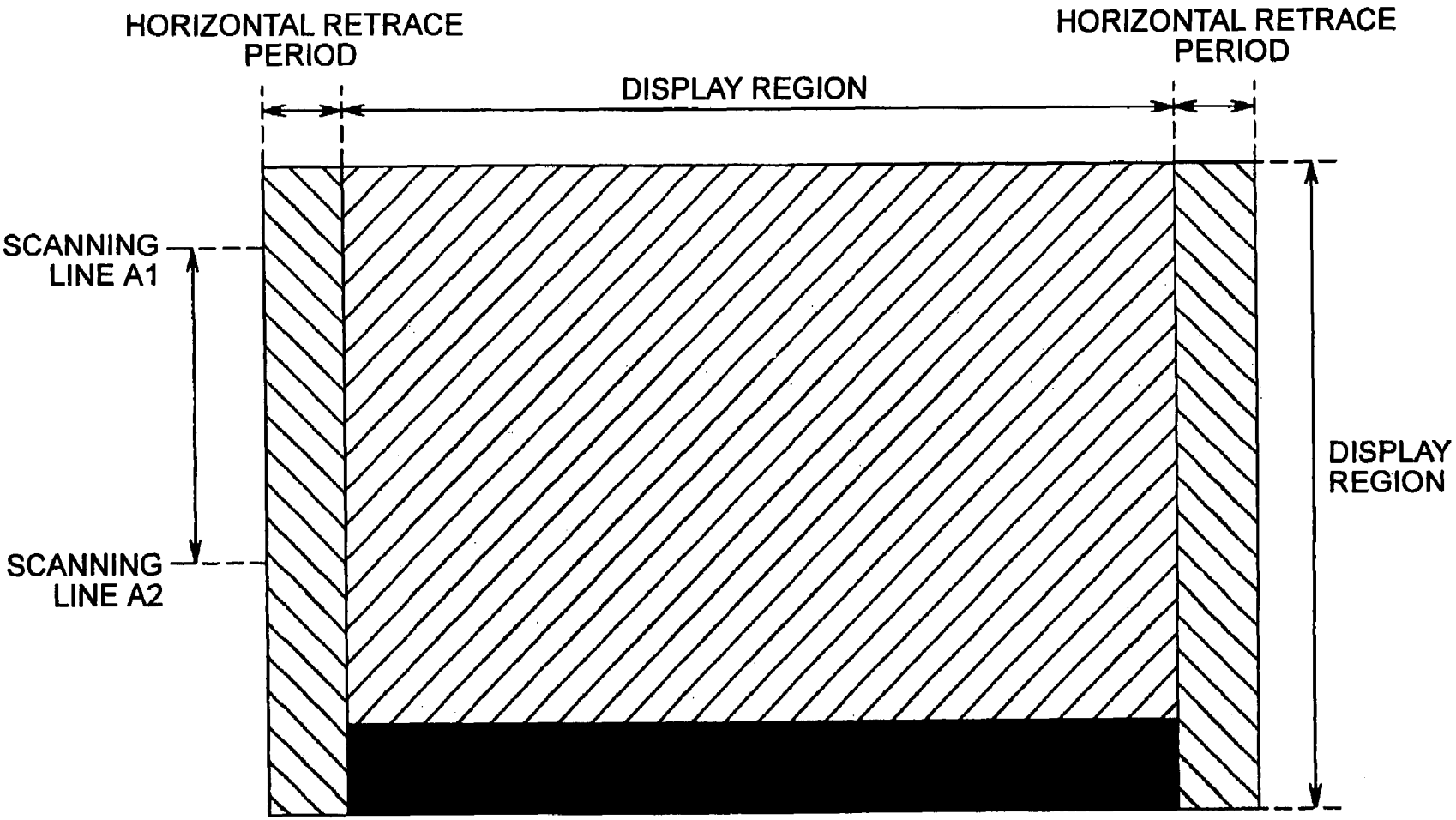
FIG. 24 is an explanatory view showing a display example in the exemplary embodiment of the present invention.
Figure 25:
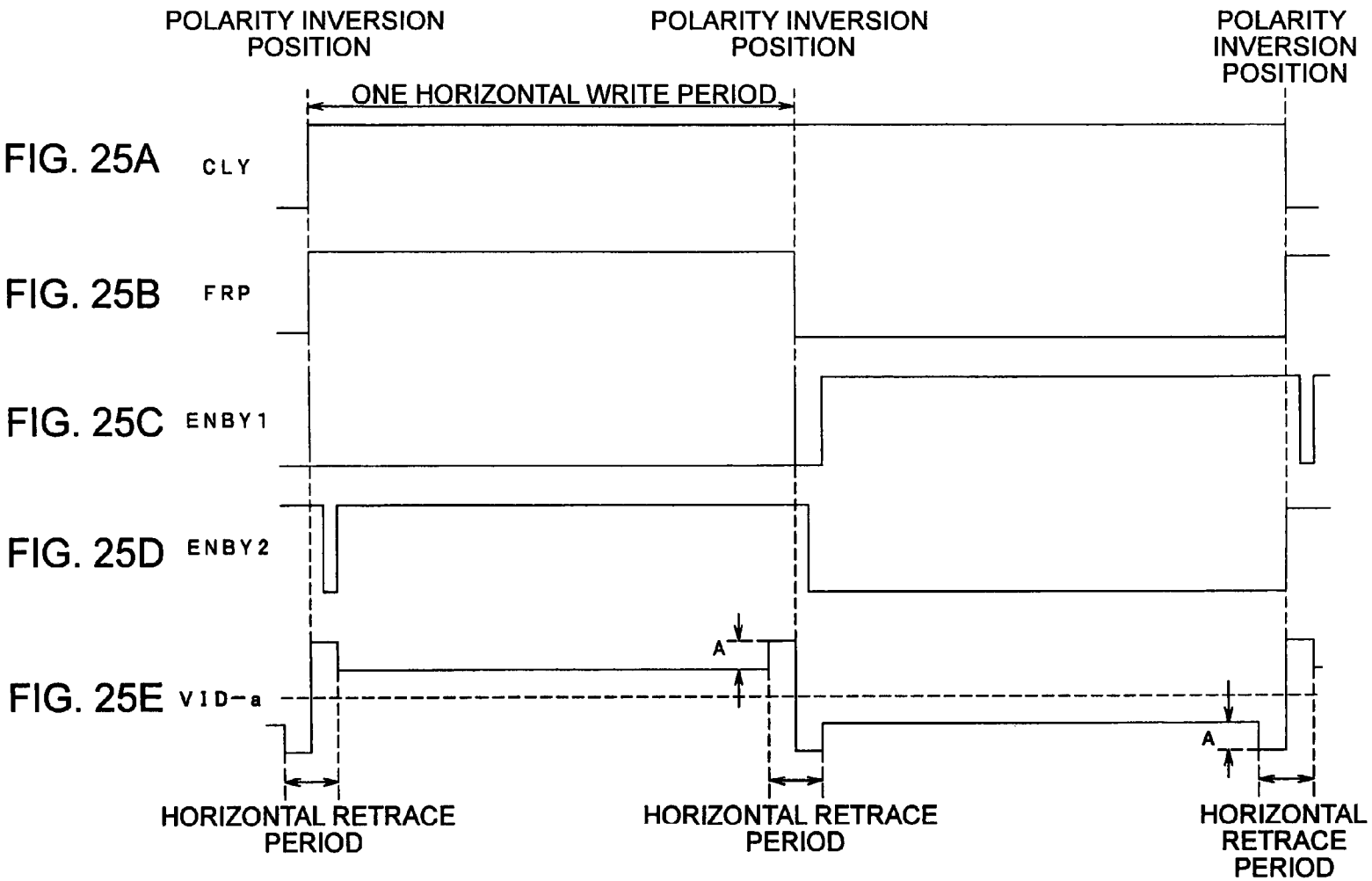
FIGS. 25A to 25E are schematic timing charts showing relationships between the enable signals ENBY1 and ENBY2 and a horizontal retrace period.

FIG. 16 is a schematic circuit diagram showing a specified configuration of a scanning driver 104*a* in FIG. 15. FIG. 17 is a schematic detailed circuit diagram of significant parts in FIG. 16. FIGS. 18A to 18L are schematic timing charts illustrating scanning in the exemplary embodiment of the present invention. FIG. 19 is a schematic explanatory view showing an image on a screen. FIG. 20 is a schematic explanatory view showing an aspect of a writing (driving) operation onto the screen. FIG. 21 is a schematic block diagram showing a specified configuration of a retrace period processing unit 65*b* in FIG. 15. FIGS. 22A to 22E are schematic timing charts showing relationships between enable signals ENBY1 and ENBY2 and a level of a horizontal retrace period in the exemplary embodiment of the present invention. FIG. 23A to 23E are schematic timing charts illustrating an example of a creation method of the enable signals ENBY1 and ENBY2. FIG. 24 is a schematic explanatory view showing a display example in the exemplary embodiment of the present invention. Moreover, in these drawings, each layer or each member has a different reduced scale so that each layer or each member can be fully recognized. Further, in FIGS. 15 to 17, the same elements as those in FIG. 1, 5, or 6 are represented by the same reference numerals, and the descriptions on the same elements will be omitted.

In FIG. 12 of the first exemplary embodiment, the blanking signal of the vertical retrace period is described, but a blanking signal in a horizontal retrace period has the same problem. That is, in the region scanning inversion driving system, as described above, the write operations are performed to two scanning lines in one horizontal period. The write operations are controlled by the enable signals ENBY1 and ENBY2. And then, whenever the enable signals ENBY1 and ENBY2 are written, the write operations of the image signals having different polarities from each other are performed. Moreover, the polarity inversion is controlled by the polarity inversion signal FRP of one horizontal period.

In the horizontal period, the horizontal retrace period is arranged in an end edge. By the way, in pattern generators or supply devices of various image signals, there is a case in which the signal level of the retrace period is not defined and the signal level of the retrace period is different for each scanning line. If so, in one write period, the variation amount of the source potential changes largely due to the signal of the horizontal retrace period. Accordingly, unevenness in the image may be caused.

The present exemplary embodiment is to address and/or solve this problem. In the present exemplary embodiment, for example, an example in which an electro-optical device is applied to a liquid crystal light valve used as a light modulation device of a projection type display device is also shown.

An electro-optical device according to the present exemplary embodiment has a display region 101*a* using liquid crystal as an electro-optical material, a scanning driver 104*b* and a data driver 201 which drive the pixels of the display region 101*a*, a controller 65 which supplies various signals to the scanning driver 104*b* and the data driver 201, a DA converter (DAC) 64, and a memory 62*b*.

The schematic configuration of the liquid crystal panel having the display region 101*a*, the scanning driver 104*b*, and the data driver in FIG. 15 is the same as that shown in FIGS. 2 and 3. Further, an equivalent circuit diagram of the element on TFT substrate is the same as that in FIG. 4.

Figure 28:
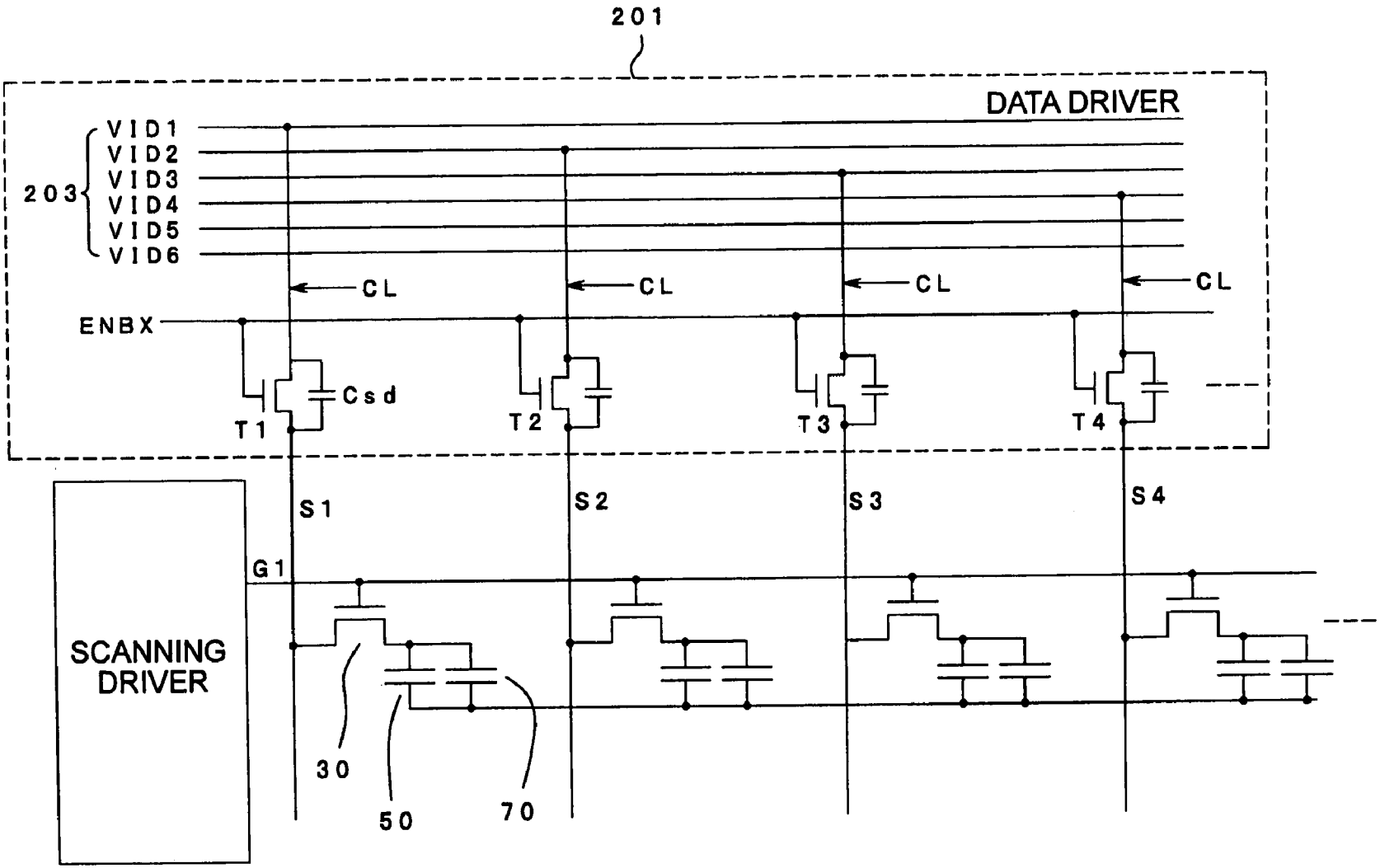
FIG. 28 is a schematic block diagram illustrating a coupling capacitor.
Figure 29:
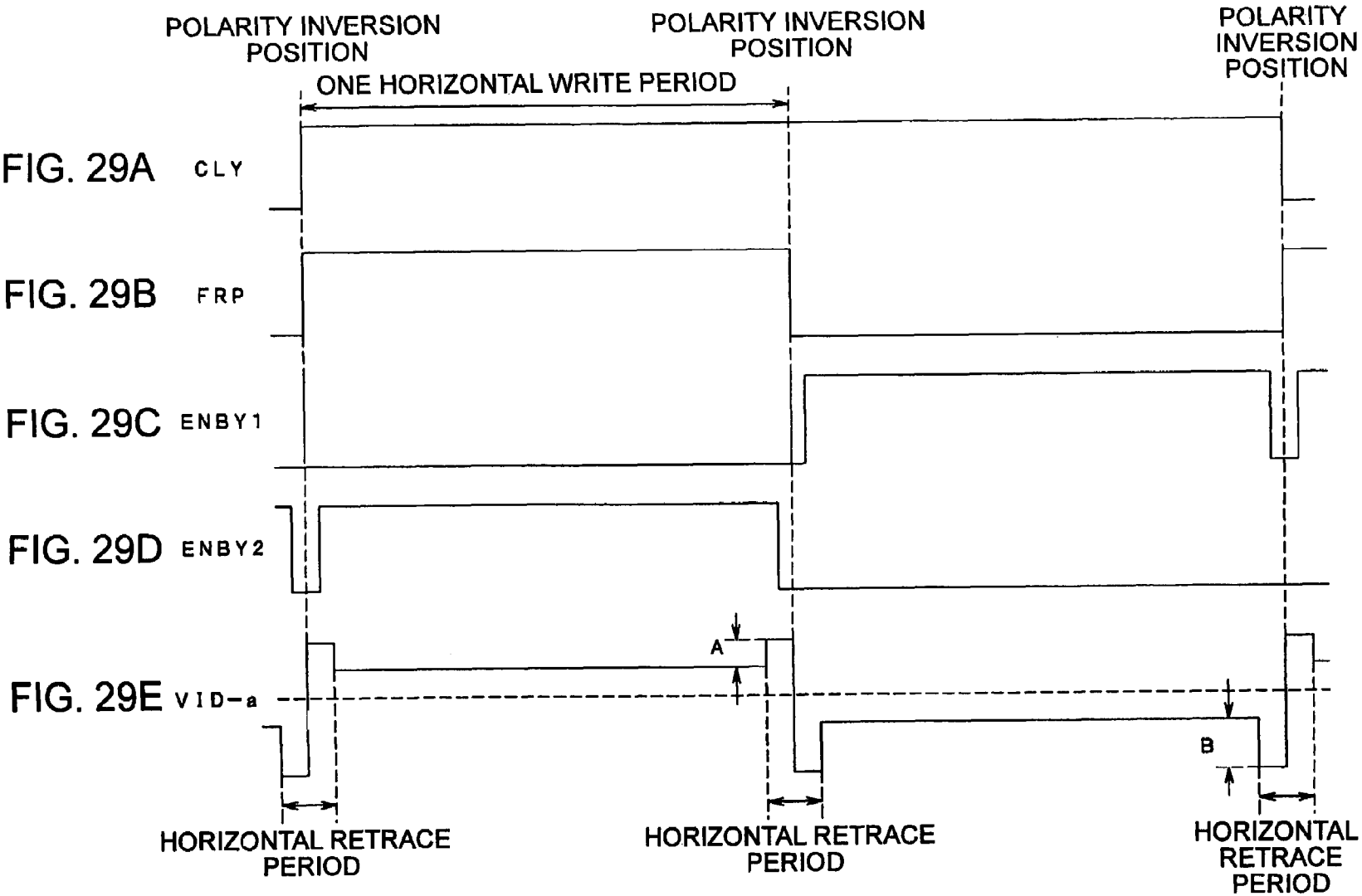
FIGS. 29A to 29E are schematic timing charts showing relationships between the enable signals ENBY1 and ENBY2 and a polarity inversion signal FRP, which generate nonconformity.
Figure 30:
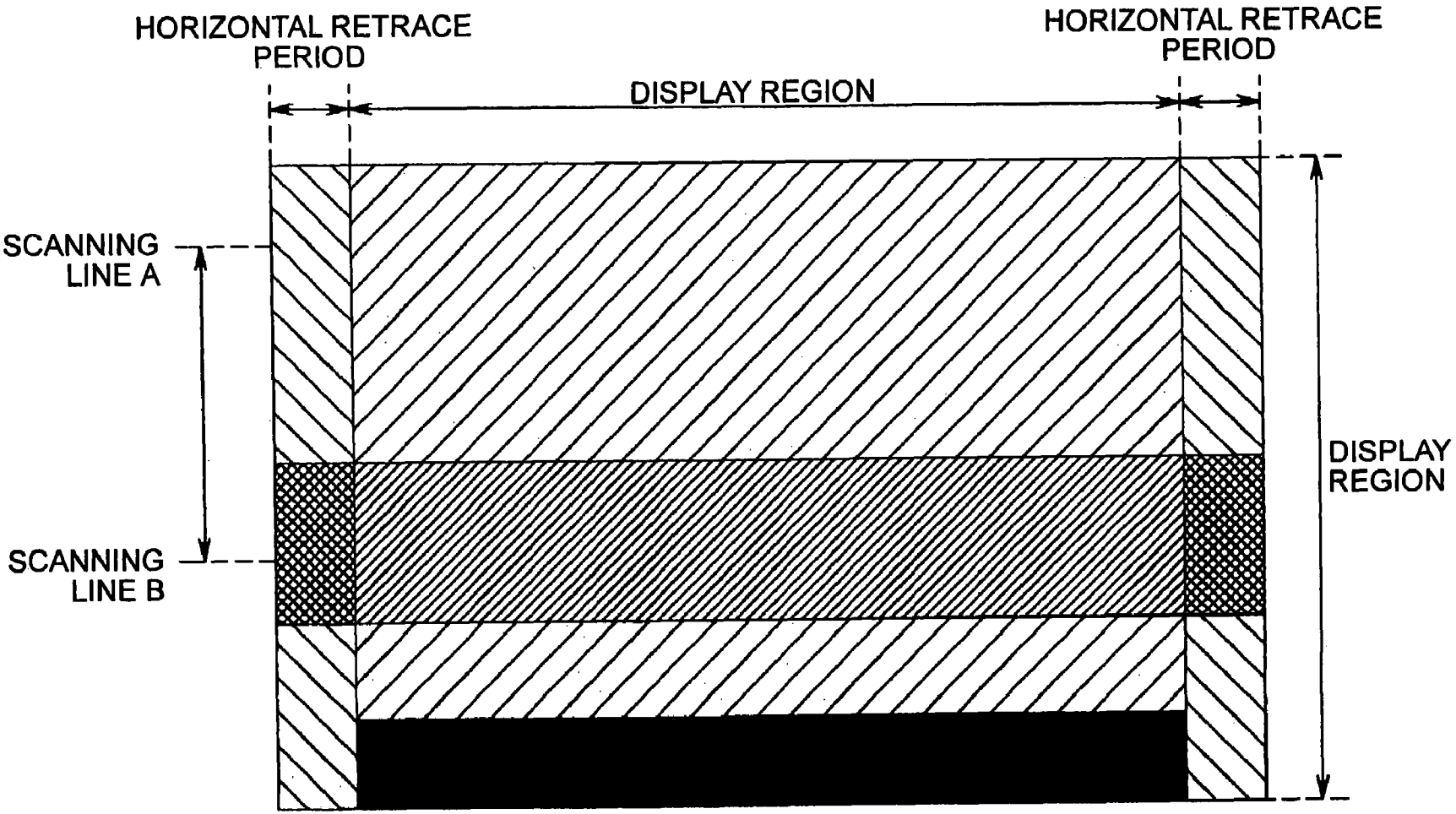
FIG. 30 is a schematic explanatory view showing an example of display unevenness.

To begin with, the cause of display unevenness will be described with reference to FIGS. 28 to 30. FIG. 28 is a schematic block diagram illustrating a coupling capacitor. FIGS. 29A to 29E are schematic timing charts showing relationships between the enable signals ENBY1 and ENBY2 which generate nonconformity and a level of horizontal retrace period. FIG. 30 is a schematic explanatory view showing an example of display unevenness.

In the example of FIG. 28, the data driver 201 has a configuration which is applied to a phase expansion, but it may not use the phase expansion. In a six-phase expansion, image signals for six horizontal pixels are input to the data driver 201 in parallel, the image signals for six horizontal pixels are simultaneously supplied to six source lines arranged parallel to each other in a horizontal direction, and image signals for one line are written onto all the source lines in a horizontal direction in one horizontal period. By the phase expansion, the time required for the write operation per one pixel can be extended.

The data driver 201 supplies outputs of six video signal lines 203 to the respective source lines S1, S2, . . . via transfer transistors T1, T2, . . . . The transfer transistors T1, T2, . . . are turned on by an enable signal ENBX in an X direction, such that the image signal input to the video signal line 203 is written onto the corresponding source lines.

By a coupling capacitor generated between a source and a drain of each of the transfer transistors T1, T2, . . . the variation of the video signal line 203 influences on each of the source lines S1, S2, . . . , even when the transfer transistors T1, T2, . . . are turned off. Now, when the potential variation of the video signal line 203 is ΔVs, the wiring capacitance of the video signal line 203 is C1, and the coupling capacitance is Csd, the capacitive coupling component ΔV to the source potential is represented by the following expression.

$$\Delta V = \Delta Vs \cdot Csd / C1$$

The enable signals ENBY1 and ENBY2 are changed into levels turning on or off the TFTs 30 corresponding to the horizontal write period. In the region scanning inversion driving system, by one (hereinafter, referred to as a first scan) and the other (hereinafter, referred to as a second scan) of twice scans in one horizontal period, the enable signals ENBY1 and ENBY2 are changed into the levels, for example, which turn off the TFTs in the horizontal retrace period, before a next horizontal write period starts, such that the write operations are performed without influencing the scanning lines 1 and 2 respectively.

FIGS. 29A to 29E are schematics showing an example in which the enable signals ENBY1 and ENBY2 are changed into the levels which turn off the TFTs 30 in the horizontal retrace period. FIG. 29A shows the transfer clock CLY, FIG. 29B shows the polarity inversion signal FRP, FIG. 29C shows the enable signal ENBY1, FIG. 29D shows the enable signal ENBY2, and FIG. 29E shows a signal VID-a which flows into the predetermined video signal line 203.

The waveform of a first half of the signal VID-a in FIG. 29E is a signal corresponding to the pixel onto which an image signal is written by the scan of the scanning line A of FIG. 30, and the waveform of a second half of the signal VID-a in FIG. 29E is a signal corresponding to a pixel onto which an image signal is written by the scan of the scanning line B in FIG. 30.

FIG. 30 shows the effective display period and the horizontal and vertical retrace periods of the image signal corresponding to the screen display. The horizontal retrace periods are arranged at both ends of each horizontal effective scanning period, and the vertical retrace period (painted portion) is arranged at an end edge of the vertical period. Now, for example, it is assumed that the entire effective display region has a predetermined gray level. In the first half of the signal VID-a in FIG. 29E, the write operations to the pixel which are connected to the scanning line A is performed. Further, in the second half of the signal VID-a in FIG. 29E, the write operation to the pixels which are connected to the scanning line B is performed. As shown in the signal VID-a of FIG. 29E, the levels of the image signals which are written by the scanning lines A and B has the predetermined same gray level.

As described above, there is a case in which the level of the horizontal retrace period is different for each scanning line. For example, in the example of FIG. 30, the horizontal retrace period of a mesh portion is close to black as compared to the horizontal retrace period of a hatched portion. For example, as shown in FIG. 29E, while the level of the retrace period of the image signal corresponding to the scanning line A is (the predetermined gray level+A), the level of the retrace of the image signal corresponding to the scanning line B is (the predetermined gray level+B) (where A<B).

Since the enable signals ENBY1 and ENBY2 are changed into the levels which turn off the TFTs 30 in the horizontal retrace period, the write operation of the display region is affected by the level of the horizontal retrace period. For example, the image signal corresponding to the scanning line A becomes an image darker than the predetermined gray level by a relatively small capacitive coupling component corresponding to the level A. To the contrary, the image signal corresponding to the scanning line B becomes an image darker than the predetermined gray level by a relatively large capacitive coupling component corresponding to the level B.

That is, at the time of scanning the scanning line B, the source potential affected by the capacitive coupling component ΔV larger than that at the time of scanning the scanning line A is written onto the pixel. Accordingly, as shown in FIG. 30, a portion where the level of the horizontal retrace period has a different range (dense hatched portion) from other levels is largely affected by the capacitive coupling component as compared to other portions, and thus display unevenness is caused.

Moreover, a black display portion or white display portion is also affected by the source potential, but it has a voltage transmittance characteristic to be saturated. Thus, it is not conspicuous in display.

Therefore, in the present exemplary embodiment, by equalizing the levels of the horizontal retrace periods in the entire horizontal period, the influence of the capacitive coupling component due to the polarity inversion can be avoided, even when the enable signals ENBY1 and ENBY2 are changed in the horizontal retrace period. As a result, display unevenness can be suppressed.

In the present exemplary embodiment, the driving circuit unit 60*b* of the liquid crystal device has a controller 65 serving as an image rearranging unit, a memory 62*b*, a DA converter 64, and so on, in addition to the data driver 201 and the scanning driver 104*b*, as shown in FIG. 15. The memory 62*b* can temporarily store an image for a half screen (for a half field) input from an exterior and can output the stored image for display.

The controller 65 has the display controller 65*a* and the retrace period processing unit 65*b* built-in. To the controller 65, a vertical synchronizing signal Vsync, a horizontal synchronizing signal Hsync, a dot clock signal dotclk, and an image signal DATA of an input image are input. The controller 65 controls the memory 62*b* and reads data corresponding to the scanning line for writing from the memory 62*b*.

The display control unit 65*a* of the controller 65 can obtain an image signal which is delayed by a predetermined period with respect to the image signal input from the exterior with the memory 62*b*. For example, the controller 65 can obtain image signals before and after a half of a vertical period from the input image signal. In addition, the controller 65 can synthesize the image signals before and after the half of the vertical period to convert the input image signal into a signal having a horizontal frequency times larger than a horizontal frequency of the input image and can rearrange signal arrangement of the image signals according to the scanning of the display region 101*a* described below to output the rearranged image signals.

The image signals from the controller 65 are supplied to the DAC 64. The DAC 64 converts the digital image signals from the controller 65 into analog signals and outputs them the data driver 201.

Further, the controller 65 generates various signals which drive the data driver 201 and the scanning driver 104*b*. In order to generate various signals, the controller 65 is provided with a timing generator (not shown). The timing generator generates various timing signals based on the vertical synchronizing signal Vsync, the horizontal synchronizing signal Hsync, and the dot clock signal dotclk which are supplied from the exterior.

That is, the controller 65 generates a transfer clock CLX, which is a signal for driving the display, or the like with the timing generator and outputs it to the data driver 201. Further, the controller 65 generates a scanning start pulse DY and transfer clocks CLY and /CLY and outputs them to the scanning driver 104*b*. Further, the controller 65 generates the enable signals ENBY1 and ENBY2 and supplies them to the scanning driver 104*b*.

The scanning start pulse DY generated by the controller 65 is a pulse signal which instructs the start of the scanning. In the present exemplary embodiment, the scanning start pulse DY is also generated twice in one vertical period. For example, the controller 65 generates the scanning start pulses DY at the timing shifted for a half vertical period. If the scanning start pulses DY are input to the scanning driver 104*b*, the scanning driver 104*b* output the scanning signals (hereinafter, referred to as gate pulses) (G1 to G2*m*) which turn on the TFTs 30 of the respective pixels to the respective scanning lines G1 to G2*m*.

The transfer clocks CLY and /CLY are signals which define scanning rates of a scanning side (Y side) and pulses which rise or fall corresponding to one horizontal period of the input image signal. As described below, the scanning driver 104*b* shifts the scanning line, to which the gate pulse is output, in synchronization with the transfer clock CLY (/CLY).

In the present exemplary embodiment, since two scanning start pulses DY in one vertical period are also generated, the gate pulses are supplied to two scanning lines which are spaced apart by the number of lines corresponding to the lag between two scanning start pulses, in one horizontal period, in the display region 101*a*.

Further, the controller 65 arranges and corrects the input image signal and its delayed signal according to the above-mentioned scanning, inverts the polarities of them for every one horizontal period, and supplies them to the data driver 201. For example, the controller 65 alternately arranges the input image signal and its delayed signal for each line to obtain the write image.

That is, in the present exemplary embodiment, the horizontal period of the image signal which is input to the data driver 201 is also a half h (=H/2) of the horizontal period H of the original input image signal. The horizontal write period of the pixels for one line of the display region 101*a* is aligned with the horizontal period of the write image.

One horizontal period H includes two horizontal write periods h. In each horizontal write period, the pixel signals corresponding to the image of the corresponding line are supplied to the pixels of two lines. The different pixel signals for two lines are written in two horizontal write periods h, and thus the enable signals ENBY1 and ENBY2 which rise and fall once in one horizontal period H are used.

The enable signals ENBY1 and ENBY2 are generated by the controller 65. Further, the controller 65 also generates the polarity inversion signal FRP which switches over the write image between the positive and the negative. The polarity inversion signal FRP is a signal of one horizontal period. In a high level period (hereinafter, referred to as 'H') of the polarity inversion signal FRP, the write operation of the positive image signal is performed, and in a low level period (hereinafter, referred to as 'L') thereof, the write operation of the negative image signal is performed.

The controller 65 generates the enable signals ENBY1 and ENBY2 having the levels which turn off the TFTs 30, in the horizontal retrace period. The pulse width of each of the enable signals ENBY1 and ENBY2 defines the horizontal write period.

And then, the scanning driver 104*b* will be described with reference to FIG. 16.

As shown in FIG. 16, the scanning driver 104*b* has a shift register 66 to which the scanning start pulse DY, the clock signal CLY, and the inverted clock signal/CLY are respectively input from the controller 65, and 2*m* AND circuits 67 to which an output from the shift register 66 is input. Output terminals of the AND circuits 67 are connected to the 2m scanning lines G1 to G2*m* respectively.

FIG. 17 shows a specified configuration of the shift register 66. The shift register 66 has a configuration corresponding to every two adjacent scanning lines. That is, the shift register 66 has a clocked inverter 66*a* which is conducted by the clock signal CLY and a clocked inverter 66*b* and an inverter 66*c* which are conducted by the inverted clock signal/CLY, corresponding to one scanning line of two adjacent scanning lines. Further, the shift register 66 has a clocked inverter 66*d* which is conducted by the inverted clock signal/CLY and a clocked inverter 66*e* and an inverter 66*f* which are conducted by the clock signal CLY, corresponding to the other scanning line.

The clocked inverter 66*a* is supplied with a pulse based on the scanning start pulse DY and is conducted by the clock signal CLY of 'H'. The clocked inverter 66*a* outputs its output to the corresponding AND circuit 67 and the inverter 66*c*. The inverter 66*c* outputs the inverted output of the clocked inverter 66*a* to the clocked inverter 66*b* and the next-stage clocked inverter 66*d*. The clocked inverter 66*b* is conducted by the inverted clock signal/CLY of 'H' and supplies its output to the input terminal of the corresponding AND circuit 67.

Further, when receiving the output of the pre-stage inverter 66*c*, the clocked inverter 66*d* outputs the output of the inverter 66*c* to the input terminal of the corresponding AND circuit 67 and the inverter 66*f* with the clock signal CLY of 'H'. The inverter 66*f* outputs the inverted output of the clocked inverter 66*d* to the clocked inverter 66*e* and the next-stage clocked inverter 66*a*. The inverter 66*f* is conducted by the inverted clock signal/CLY of 'H' and supplies its output to the input terminal of the corresponding AND circuit 67.

The scanning start pulse DY which is input to the clocked inverter 66*a* is a pulse having a predetermined width, and the pulse based on the scanning start pulse DY is sequentially transferred to the respective AND circuits 67 via the clocked inverter 66*a*, the inverter 66*c*, the clocked inverter 66*d*, and the inverter 66*f*. Further, the output of the clocked inverter 66*b* is supplied to the AND circuits 67, and thus the rising and falling of the output pulse of each of the AND circuits 67 are defined by the clock signal CLY.

In addition, the AND circuits 67 are also supplied with the enable signals ENBY1 and ENBY2. For example, the AND circuits 67 which correspond to odd-numbered scanning lines are supplied with the enable signal ENBY2 and the AND circuits 67 which correspond to even-numbered scanning lines are supplied with the enable signal ENBY1. The AND circuits 67 calculates a logical sum of two inputs and output it to the respective scanning lines as a scanning signal. Accordingly, the pulse width of the gate pulse is aligned with the pulse width of each of the enable signals ENBY1 and ENBY2. The pulse width becomes the horizontal write period.

Next, operations of the driving circuit unit 60*b* will be described in detail with reference to FIGS. 18A to 18L.

As described above, in the region scanning inversion driving system, one horizontal period is divided into the first half and the second half, and the write image is written onto the pixels of two different lines. The write operation by the scan (hereinafter, referred to as a first scan) of the first half of the horizontal period and the write operation by the scan (hereinafter, referred to as a second scan) of the second half of the horizontal period are shifted by one line for every one horizontal period. That is, on the screen, the write operations are sequentially performed by two scanning lines (hereinafter, referred to as a first scanning line or a scanning line 1 and a second scanning line or a scanning line 2) which are spaced apart by a predetermined interval from each other.

In this case, normally, the scans of the first scanning line and the second scanning line are generated to be spaced apart by a half of the vertical period from each other.

In order to generate the first and second scanning lines, in the present exemplary embodiment, the driving circuit unit 60*b* outputs the scanning start pulse DY twice in one vertical period of the input image signal. The scanning start pulse DY is shifted through the shift register 66 of the scanning driver 104*b* according to the clock signal CLY of one horizontal period in which one pulse rises and falls for every one horizontal write period.

Since two scanning start pulses DY are generated in one vertical period, for example, the gate pulses of 'H' which are generated from the AND circuits 67 of the respective scanning lines based on the first scanning start pulse DY are shifted to a next stage at the horizontal period H of the input image signal. The pulse width of each of the gate pulses is defined by the 'H' period of each of the enable signals ENBY1 and ENBY2. Further, the gate pulses of 'H' which are generated from the AND circuits 67 of the respective scanning lines based on the second scanning start pulse DY are shifted to a next stage at the horizontal period H of the input image signal. The pulse width of each of the gate pulses is defined by the 'H' period of each of the enable signals ENBY1 and ENBY2 (see FIGS. 18D to 18K).

As such, the gate pulses are alternately output to two positions on the screen which are spaced apart by m scanning lines from each other in one horizontal period H. For example, when the first scanning line and the second scanning line are generated to be spaced apart by Gm from each other, the scan is performed in an order of the scanning line G1, the scanning line Gm+1, the scanning line G2, the scanning line Gm+2, the scanning line G3, . . . .

On the other hand, the polarity of a data signal Sx output from the data driver 201 is inverted into a positive potential or a negative potential for every one horizontal write period h on a basis of a common potential LCCOM. Therefore, while the polarity of the data signal Sx is inverted for every one horizontal write period, the gate pulses are alternately output to two positions on the screen which are spaced apart by m scanning lines from each other in the above-mentioned order. As a result, when the first scanning line and the second scanning line are spaced apart by Gm from each other, as shown in FIG. 19, in any one horizontal period, for example, dots (pixels) corresponding to the scanning lines G3 to Gm+2 on the screen become a positive region in which data having positive potential is written. Further, dots corresponding to the scanning lines G1 to G2 and Gm+3 to G2*m* on the screen become negative regions in which data having negative potential is written.

Moreover, in the present exemplary embodiment, one field data is converted into first field data and second field data. For example, the image signal itself input from the exterior is written onto the video signal line 203 as first field data. On the other hand, second field data which is delayed with respect to the image signal is created by storing the image signal in the memory 62*b*. First field data and second field data are alternately written and the polarity of second field data is inverted with respect to first field data.

That is, since one frame data is converted into two field data and the image signal itself input from the exterior is used as one field data, the image is written substantially at a double speed. In the related art, when the double speed driving is performed, the memory capacity for two screens (for two fields) is required. In the present exemplary configuration, however, the image signal itself from the exterior is output to the video signal line 203, and the half of the screen is written, such that the memory capacity may be the half capacity of the entire screen (that is, for a half field). For this reason, the memory capacity can be reduced to one fourth as compared to the related art, and thus the cost for members can be drastically reduced.

FIG. 19 shows an image of a screen at a moment of any one horizontal period and FIG. 20 shows a state of a change in polarity on the screen as the time goes by. When a horizontal axis of FIG. 20 is the time (unit; one horizontal write period), for example, in a first horizontal write period, data having a negative potential is written into dots corresponding to the scanning line G2*m*. And then, in a next second horizontal write period, data having a positive potential is written into dots corresponding to the scanning line Gm+1, into which data having the negative potential was written in the first horizontal write period. Further, in a next third horizontal write period, data having a negative potential is written into dots corresponding to the scanning line G1, into which data having the positive potential was written before the ½ vertical period.

Therefore, the positive region and the negative region respectively move by one line for every one horizontal write period h, and when the scanning line moves the half of the screen, the positive region and the negative region are completely inverted. That is, a rewrite operation for one screen is performed. The rewrite operation of the screen is performed at the ½ vertical period, and in one vertical period, the respective pixels can be rewritten once more. That is, according to this method, when the scanning line moves the entire screen, the rewrite operation can be performed twice.

As described above, the image signal input to the data driver 201 is arranged to have the transfer rate twice as fast as the same image before and after the predetermined period (the ½ vertical period in the example of FIG. 20). As a result, the same image is written onto the respective pixels of the liquid crystal panel twice in one vertical period, which making it possible to perform the so-called double speed scanning.

In the present exemplary embodiment, the retrace period processing unit 65*b* can fix the level in the entire retrace period to a predetermined value.

FIG. 21 is a block diagram showing a specified configuration of the retrace period processing unit 65*b* in FIG. 15. A horizontal counter 71 of the retrace period processing unit 65*b* is supplied with the horizontal synchronizing signal Hsync and the dot clock signal dotclk and a vertical counter 72 thereof is supplied with the vertical synchronizing signal Vsync and the dot clock signal dotclk. The horizontal counter 71 counts the dot clock dotclk on a basis of the horizontal synchronizing signal Hsync and assigns the timing of the horizontal retrace period to a blanking signal inserting unit 73. Further, the vertical counter 72 counts the dot clock dotclk on a basis of the vertical synchronizing signal Vsync and assigns the timing of the vertical retrace period to the blanking signal inserting unit 73.

A blanking signal generating unit 74 generates a blanking signal having a predetermined gray level and outputs it to the blanking signal inserting unit 73, thereby to define the level of the retrace period. Moreover, the blanking signal generating unit 74 outputs the blanking signal having transmittance of 60±20%, instead of a black level having transmittance of 0 (zero). Further, when the image signal is represented by 256 gray-scale levels (8 bits), the blanking signal generating unit 74 output the pseudo blanking signal of a gray-scale level of 200±30. Preferably, when the image signal is represented by 256 gray-scale levels, for example, a gray level of a gray-scale level 40 to 80 is set.

The blanking signal inserting unit 73 is supplied with the image signal DATA. The blanking signal inserting unit 73 inserts the blanking signal from the blanking signal generating unit 74, instead of the input image signal DATA, for at least the horizontal retrace period and outputs it. Moreover, for the vertical retrace period, in addition to the horizontal retrace period, the blanking signal inserting unit 73 may insert the blanking signal having the predetermined gray level.

The controller 65 changes the enable signals ENBY1 and ENBY2 from 'H' to 'L' or from 'L' to 'H' in the horizontal retrace period.

FIGS. 22A to 22E are schematics showing relationships between turning points of the enable signals ENBY1 and ENBY2 and the horizontal retrace period. FIG. 22A shows the transfer clock CLY, FIG. 22B shows the polarity inversion signal FRP, FIG. 22C shows the enable signal ENBY1, FIG. 22D shows the enable signal ENBY2, and FIG. 22E shows a signal VID-a flowing through video signal line 203 when any of predetermined write signals by the first and second scanning lines is a signal having the gray level.

As described above, the transfer clock CLY is a pulse which rises or falls corresponding to one horizontal period of the input image signal. In synchronization with the transfer clock CLY, the first scanning line and the second scanning line are shifted by one line in one horizontal period. The polarity inversion signal FRP is a signal which rises or falls for every one horizontal period. The image signal of the write image becomes positive in the 'H' period and it becomes negative in the 'L' period.

In the present exemplary embodiment, in the horizontal retrace period just after the start timing of the 'H' period of the polarity inversion signal FRP, the enable signal ENBY2 changes from 'L' to 'H', and in the horizontal retrace period just before the end timing of the 'H' period of the polarity inversion signal FRP, the enable signal ENBY2 change from 'H' to 'L'. Similarly, the enable signal ENBY1 changes from 'L' to 'H' in the horizontal retrace period just after the start timing of the 'L' period of the polarity inversion signal FRP and it changes from 'H' to 'L' in the horizontal retrace period just before the end timing of the 'L' period of the polarity inversion signal FRP.

FIGS. 23A to 23D are schematics showing a generating method of the enable signals ENBY1 and ENBY2. An enable signal generating unit 65*b* is provided with an H counter (H_counter) which is not shown. The H counter generates a clock clk having a frequency sufficiently higher than that of the horizontal synchronizing signal Hsync. The enable signal generating unit 65*b* counts the output of the H counter on a basis of the horizontal synchronizing signal Hsync shown in FIG. 23A and determines the rising timing and the falling timing of each of the enable signals ENBY1 and ENBY2. In the example of FIGS. 23A to 23E, the enable signal ENBY1 changes from 'H' to 'L' at the timing before the five clocks of the H counter on a basis of the rising timing of the horizontal synchronizing signal Hsync. Further, the enable signal ENBY2 changes from 'L' to 'H' at the timing after the five clocks of the H counter on a basis of the rising timing of the horizontal synchronizing signal Hsync and changes from 'H' to 'L' before the five clocks of the H counter.

In the 'H' period of each of the enable signals ENBY1 and ENBY2, the gate pulses are supplied to the TFTs 30 connected to the respective scanning lines to turn them on, and thus the source potential is written onto liquid crystal. In the 'L' period of each of the enable signal ENBY1 and ENBY2, the TFTs 30 connected to the respective scanning lines are turned off, and thus the source potential is not written onto liquid crystal. The write operation for each line is affected by the source potential at the timing that the enable signals ENBY1 and ENBY2 change to the 'L' level, that is, the level of the horizontal retrace period.

Now, it is assumed that the first scanning line and the second scanning line are scanning lines A1 and A2 shown in FIG. 24 at the predetermined timing. And then, it is assumed that the image signals having the gray level shown in the first half and the second half of the signal VID-a in FIG. 22E are written by the scanning lines A1 and A2. That is, the image signal of the first horizontal write period of the signal VID-a in FIG. 22E is written by the scanning line A1 according to the enable signal ENBY2 and the image signal of the second horizontal write period of the signal VID-a in FIG. 22E is written by the scanning line A2 according to the enable signal ENBY1.

The capacitive coupling component according to the difference between the image signal of the period of the effective display region and the signal level of the horizontal retrace period varies the potential of the source line. At the time when the variation is generated, since the enable signals ENBY1 and ENBY2 are the 'H' level, the source potential based on the level of the horizontal retrace period is written onto the pixel. However, in the present exemplary embodiment, the level of the horizontal retrace period is constant as the predetermined gray level for all the scanning lines by means of the blanking signal generating unit 74. Therefore, the variation of the source potential based on the level of the horizontal retrace period is common to all the scanning lines, and thus there is no case in which display unevenness occurs. Further, the variation of the source potential has a sufficiently small value since the blanking signal has the gray level equal to the image signal of the display region, and thus there is little influence by the variation of the source potential on display. In such a manner, as shown in FIG. 24, in the entire screen, the image with no display unevenness is displayed.

As such, in the present exemplary embodiment, even when the enable signals ENBY1 and ENBY2 which supply the gate pulses to the first and second scanning lines are set to be inactive in the horizontal retrace period, the variation of the source potential is the same for all the scanning lines since the level of the horizontal retrace period for all the scanning lines is set to the constant gray level. As a result, display unevenness can be reduced or prevented.

Further, in the present exemplary embodiment, the level of the horizontal retrace period is constant for all the scanning lines. Thus, even when a delay in the enable signals ENBY1 and ENBY2 occurs, display unevenness can be reduced or prevented.

FIGS. 25A to 25E are schematics showing relationships between the turning points of the enable signals ENBY1 and ENBY2 and the horizontal retrace period in the above-mentioned case. FIGS. 25A to 25E correspond to FIGS. 22A to 22E. By a transfer delay of the enable signals ENBY1 and ENBY2 or the like, there is a case in which the enable signals ENBY1 and ENBY2 change into the levels which turn off the TFTs 30 after the delayed polarity inversion, as shown in FIGS. 25A to 25E.

In this case, if the delay does not exceed the horizontal retrace period, the variation of the source potential is based on the level of the horizontal scanning period and is common to all the scanning lines. Therefore, in this case, display unevenness can also be reduced and/or prevented.

Figure 26:
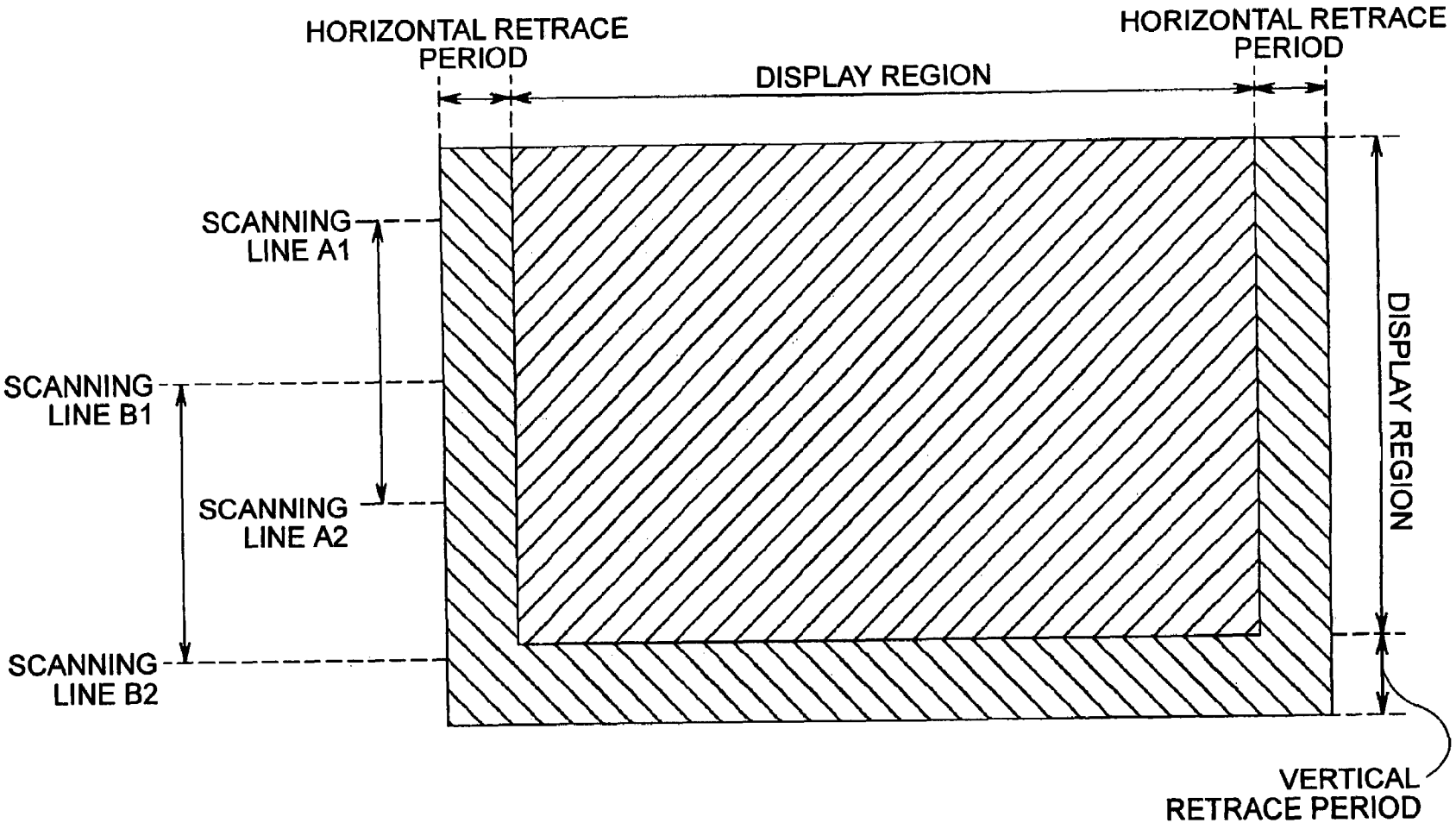
FIG. 26 is a schematic explanatory view showing an example in which a signal level of a vertical retrace period and a signal level of a horizontal retrace period are equalized.

FIG. 26 is a schematic showing an example in which the retrace period signal inserting unit 73 inserts blanking signal of the predetermined gray level for the vertical retrace period, in addition to the horizontal retrace period. That is, in this case, the levels of the image signals of the horizontal retrace period and the vertical retrace period are constant as the gray level.

There is a case in which the image signal of the vertical retrace period is set to a predetermined black level. In this case, when one of the scanning lines 1 and 2 is a scanning line B1 of the display region and the other is a scanning line B2 of the vertical retrace period in the region scanning inversion driving system, the difference between the image signal level of the display region and the image signal level of the vertical retrace period becomes large, and the capacitive coupling component $\Delta V$ has a relatively large value. That is, in this case, the variation of the source potential largely influences the write operation, such that display unevenness may be caused.

Therefore, in addition to the horizontal retrace period, the vertical retrace period should be set to the same gray level. Accordingly, the variation of the source potential is small similarly for all the scanning lines A1, A2, B1, and B2, and thus display unevenness can be suppressed.

Figure 27:
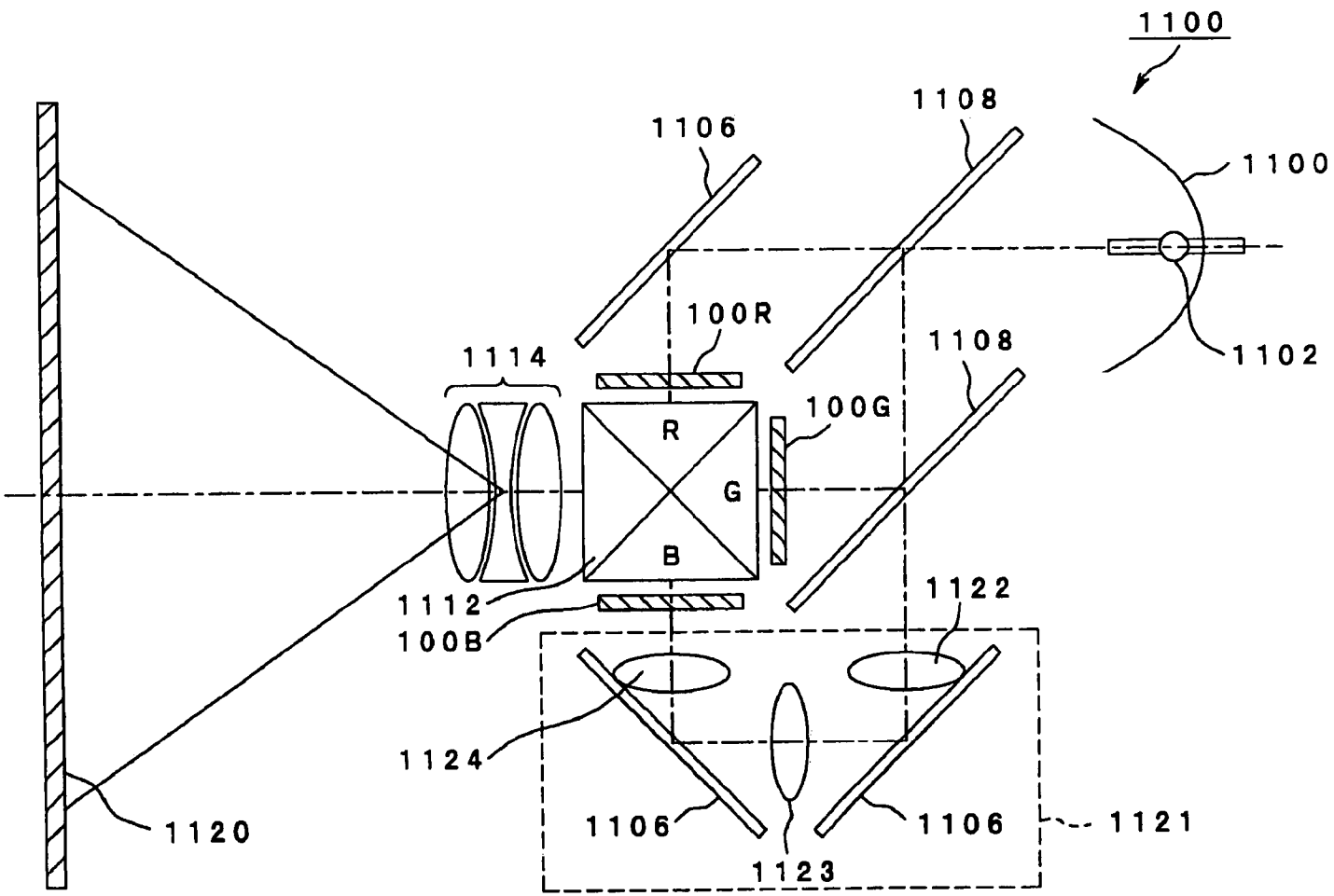
FIG. 27 is a schematic showing a configuration of an example of a so-called three-plate projection type liquid crystal display device (liquid crystal projector) in which three liquid crystal light valves according to the above-mentioned exemplary embodiment are used.

FIG. 27 is a schematic showing a configuration of an example of a so-called three-plate projection type display device (a liquid crystal projector) which uses three liquid crystal light valves according to the above-mentioned exemplary embodiment. In FIG. 27, reference numeral 1100 denotes a light source, 1108 denotes a dichroic mirror, 1106 denotes a reflecting mirror, 1122, 1123, and 1124 denote relay lenses, 100R, 100G, and 100B denote liquid crystal light valves, 1112 denotes a crossed dichroic prism, and 1114 denotes a projection lens system.

The light source 1100 includes a lamp 1102 such as a metal halide lamp and a reflector 1101 for reflecting light from the lamp 1102. The dichroic mirror 1108 for reflecting a blue light component and a green light component transmits a red light component of white light from the light source 1100 and reflects the blue light component and the green light component. The transmitted red light component is reflected by the reflecting mirror 1106 and enters the liquid crystal light valve 100R for red.

On the other hand, the green light component among the color light components reflected by the dichroic mirror 1108 is reflected by the dichroic mirror 1108 for reflecting the green light component and enters the liquid crystal light valve 100G for green. The blue light component passes through the second dichroic mirror 1108. In order to compensate for the difference of the blue light component in optical path length from the green light component and red light component, light guide device 1121 made of a relay lens system having an incident lens 1122, a relay lens 1123, and an emission lens 1124 is provided. The blue light component enters the liquid crystal light valve 100B for blue therethrough.

The three light components modulated by the light valves 100R, 100G, and 100B enter the crossed dichroic prism 1112. In the prism 1112, four rectangular prisms are bonded together, and a dielectric multilayer film for reflecting the red light component and a dielectric multilayer film for reflecting the blue light component are arranged in the shape of a cross on the inner surfaces thereof. These dielectric multilayer films combine the three light components, thereby forming light representing a color image. The combined light is projected onto a screen 1120 by the projection lens system 1114 serving as a projection optical system, so that an image is enlarged and displayed thereon.

Since the projection type liquid crystal display device having the above-mentioned configuration uses the electro-optical device according to the above-mentioned exemplary embodiment, the projection type liquid crystal display device having excellent display uniformity can be realized.

Moreover, the electro-optical device of exemplary embodiments of the present invention can be similarly applied to an active matrix type liquid crystal panel (for example, a liquid crystal panel having TFTs (thin film transistors) or TFDs (thin film diodes) as switching elements), in addition to a passive matrix type liquid crystal panel. Further, exemplary embodiments of the present invention can be applied to various electro-optical devices such as an electroluminescent device, an organic electroluminescent device, a plasma display device, an electrophoretic display device, a device using an electron emission (Field Emission Display, Surface-Conduction Electro-Emitter Display, and so on), a DLP (Digital Light Processing) (or DMD: Digital Micromirror Device), or the like, in addition to the liquid crystal panel.

Having described the preferred exemplary embodiments of the invention referring to the accompanying drawings, it should be understood that exemplary embodiments of the present invention are not limited to those precise exemplary embodiments and various changes and modifications thereof could be made by one skilled in the art without departing from the spirit or scope of the exemplary embodiments of the invention as defined in the appended claims.

What is claimed is:

1. A driving circuit for an electro-optical device, including a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements, the driving circuit comprising:

a scanning driver, with respect to the display unit, to select n, where n is an integer of 2 or greater, scanning lines spaced apart from each other in one horizontal period of an input image corresponding to a number of pixels in the display unit to sequentially supply gate pulses to the selected n scanning lines and to shift the selected n scanning lines by one line in the next one horizontal period;

an image rearranging unit to convert a blanking signal included in the input image into a blanking signal having a predetermined level, to synthesize an input image including the level-converted blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

2. The driving circuit for an electro-optical device according to claim 1, the image rearranging unit setting a gray level as the predetermined level.

3. The driving circuit for an electro-optical device according to claim 1, the image rearranging unit setting the level of the blanking signal to an application voltage of the pixel electrodes required for a display-unit transmittance of 60±20%.

4. The driving circuit for an electro-optical device according to claim 1, when the write image is represented by 256 gray-scale levels, the image rearranging unit setting the level of the level-converted blanking signal to a gray-scale level of 200±30.

5. The driving circuit for an electro-optical device according to claim 1, the image rearranging unit performing a write operation by the blanking signal with respect to a dummy pixel adjacent to an effective pixel among the input image.

6. A driving method for an electro-optical device including a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements, the driving method comprising:

first, with respect to the display unit, scanning lines spaced apart from each other in one horizontal period of an input image corresponding to a number of pixels in the display unit to sequentially supply gate pulses to the selected n scanning lines and of shifting the selected n scanning lines by one line in the next one horizontal period;

second, converting a blanking signal included in the input image, into a blanking signal having a predetermined gray level, synthesizing an input image including the level-converted blanking signal with a delayed signal thereof, and arranging the synthesized image having a horizontal frequency n times larger than a horizontal frequency of the input image, in a signal arrangement according to scanning in the first step, thereby obtaining a write image; and third, receiving an image signal of the write image obtained in the second step and inverting the polarity of the image signal for every horizontal write period, the horizontal write period being 1/n times smaller than the horizontal period of the input image, to supply the image signal to the plurality of source lines.

7. An electro-optical device, comprising:

a display unit having pixels formed at intersections of a plurality of source lines and a plurality of scanning lines, arranged to cross each other and an electro-optical material driven by turning on switching elements provided in the pixels by scanning signals supplied via the scanning lines and by supplying image signals supplied to the source lines to pixel electrodes of the respective pixels via the switching elements;

a scanning driver to select n, where n is an integer of 2 or greater, scanning lines spaced apart from each other in one horizontal period of an input image corresponding to the number of pixels in the display unit to sequentially supply gate pulses to the selected n scanning lines with respect to the display unit and to shift the selected n scanning lines by one line in the next one horizontal period;

an image rearranging unit to convert a blanking signal included in the input image into a blanking signal having a predetermined level, to synthesize an input image including the level-converted blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

8. An electronic apparatus, comprising:

a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements;

a scanning driver to select n, where n is an integer of 2 or greater, scanning lines spaced apart from each other in one horizontal period of an input image corresponding to the number of pixels in the display unit to sequentially supply gate pulses to the selected n scanning lines with respect to the display unit and to shift the selected n scanning lines by one line in the next one horizontal period;

an image rearranging unit to convert a blanking signal included in the input image into a blanking signal having a predetermined level, to synthesize an input image including the level-converted blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

9. A driving circuit for an electro-optical device including a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements, the driving circuit comprising:

a scanning driver, with respect to a display unit, to select n, where n is an integer of 2 or greater, scanning lines spaced apart from each other in one horizontal period of an input image corresponding to the number of pixels in the display unit to sequentially supply gate pulses to the selected n scanning lines and to shift the selected n scanning lines by one line in the next one horizontal period;

an image rearranging unit to convert a blanking signal included in the input image into a blanking signal having a predetermined gray level, to synthesize an input image including the level-converted blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

10. The driving circuit for an electro-optical device according to claim 9, the image rearranging unit converting signals of a horizontal retrace period and a vertical retrace period included in the input image into blanking signals having a predetermined gray level.

11. The driving circuit for an electro-optical device according to claim 9, further comprising:

an enable signal generating unit to generate enable signals to select the n scanning lines spaced apart from each other in one horizontal period of the input image, a turning point between a logical value to not select the scanning line and a logical value to select the scanning line being set in a horizontal retrace period of the image signal.

12. The driving circuit for an electro-optical device according to claim 9, the image rearranging unit setting the level of the blanking signal to an application voltage of the pixel electrodes required for a display-unit transmittance of 60±20%.

13. The driving circuit for an electro-optical device according to claim 9, when the write image is represented by 256 gray-scale levels, the image rearranging unit setting the level of the blanking signal to a gray-scale level of 200±30.

14. A driving method for an electro-optical device including a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements, the driving method comprising:

first, with respect to a display unit, selecting n, where n is an integer of 2 or greater, scanning lines spaced apart from each other in one horizontal period of an input image corresponding to the number of pixels in the display unit to sequentially supply gate pulses to the selected n scanning lines and of shifting the selected n scanning lines by one line in the next one horizontal period;

second, converting a signal of a horizontal retrace period included in the input image, into a blanking signal having a predetermined gray level, synthesizing an input image including the blanking signal with a delayed signal thereof, and arranging the synthesized image having a horizontal frequency n times larger than a horizontal frequency of the input image, in a signal arrangement according to scanning in the first step, thereby obtaining a write image; and third, receiving an image signal of the write image obtained in the second step and inverting the polarity of the image signal for every horizontal write period, the horizontal write period being 1/n times smaller than the horizontal period of the input image, to supply the image signal to the plurality of source lines.

15. The driving method for an electro-optical device according to claim 14, the second step converting signals of a horizontal retrace period and a vertical retrace period included in the input image into blanking signals having a predetermined gray level.

16. The driving method for an electro-optical device according to claim 14, further comprising:

generating enable signals to select the n scanning lines spaced apart from each other in one horizontal period of the input image, a turning point between a logical value of not selecting the scanning line and a logical value of selecting the scanning line being set in a horizontal retrace period of the image signal.

17. The driving method for an electro-optical device according to claim 14, the second step setting the level of the blanking signal to an application voltage of the pixel electrodes required for a display-unit transmittance of 60±20%.

18. The driving method for an electro-optical device according to claim 14, when the write image is represented by 256 gray-scale levels, the second step setting the level of the blanking signal to a gray-scale level of 200±30.

19. An electro-optical device, comprising:

a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements;

a scanning driver to select n, where n is an integer of 2 or greater, scanning lines spaced apart from each other in one horizontal period of an input image corresponding to the number of pixels in the display unit to sequentially supply gate pulses to the selected n scanning lines with respect to the display unit and to shift the selected n scanning lines by one line in the next one horizontal period;

an image rearranging unit to convert a signal of a horizontal retrace period included in the input image into a blanking signal having a predetermined gray level, to synthesize an input image including the blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

20. An electronic apparatus, comprising:

a display unit having pixels formed at intersections of a plurality of source lines and a plurality of scanning lines arranged to cross each other and an electro-optical material driven by turning on switching elements provided in the pixels by scanning signals supplied via the scanning lines and by supplying image signals supplied to the source lines to pixel electrodes of the respective pixels via the switching elements;

a scanning driver to select n, where n is an integer of 2 or greater, scanning lines spaced apart from each other in one horizontal period of an input image corresponding to the number of pixels in the display unit to sequentially supply gate pulses to the selected n scanning lines with respect to the display unit and to shift the selected n scanning lines by one line in the next one horizontal period;

an image rearranging unit to convert a signal of a horizontal retrace period included in the input image into a blanking signal having a predetermined gray level, to synthesize an input image including the blanking signal with a delayed signal thereof, and to arrange the synthesized image having a horizontal frequency n times larger than a horizontal frequency of the input image in a signal arrangement according to scanning of the scanning driver, thereby obtaining a write image; and a data driver to receive an image signal of the write image from the image rearranging unit and to invert the polarity of the image signal for every horizontal write period, the horizontal write period being 1/n times smaller than the horizontal period of the input image, to supply the image signal to the plurality of source lines.

* * * * *